US007613604B1

(12) United States Patent
Malah et al.

(10) Patent No.: US 7,613,604 B1
(45) **Date of Patent: *Nov. 3, 2009**

(54) SYSTEM FOR BANDWIDTH EXTENSION OF NARROW-BAND SPEECH

(75) Inventors: David Malah, Kiryat-Chayim (IL); Richard Vandervoort Cox, New Providence, NJ (US)

(73) Assignee: AT&T Intellectual Property II, L.P., New York, NY (US)

( * ) Notice: Subject to any disclaimer, the term of this patent is extended or adjusted under 35 U.S.C. 154(b) by 27 days.

This patent is subject to a terminal disclaimer.

(21) Appl. No.: 11/691,160

(22) Filed: Mar. 26, 2007

Related U.S. Application Data

(63) Continuation of application No. 11/113,463, filed on Apr. 25, 2005, now Pat. No. 7,216,074, which is a continuation of application No. 09/971,375, filed on Oct. 4, 2001, now Pat. No. 6,895,375.

(51) Int. Cl.
*G10L 21/00* (2006.01)

(52) U.S. Cl. ..... 704/205; 704/217; 704/218

(58) Field of Classification Search ..... 704/205, 704/217, 218

See application file for complete search history.

(56) References Cited

U.S. PATENT DOCUMENTS 5,978,759 A 11/1999 Tsushima et al.
6,323,907 B1 11/2001 Hwang
6,691,083 B1 2/2004 Breen (Continued)

FOREIGN PATENT DOCUMENTS

EP 0 287 104 A 4/1988

(Continued)

OTHER PUBLICATIONS

Yasukawa H Ed—Bunnell H T et al. "Restoration of wide band signal from telephone speech using linear prediction error processing", Spoken Language, 1996. ICSLP 96 Proceedings., Fourth International Conf. on Philadephia, PA, USA Oct. 3-6, 1996, New York, NY, USA IEEE, US, Oct. 3, 1996, pp. 901-904.

(Continued)

*Primary Examiner*—Daniel D Abebe

(57) ABSTRACT

A system and method are disclosed for extending the bandwidth of a narrowband signal such as a speech signal. The method applies a parametric approach to bandwidth extension but does not require training. The parametric representation relates to a discrete acoustic tube model (DATM). The method comprises computing narrowband linear predictive coefficients (LPCs) from a received narrowband speech signal, computing narrowband partial correlation coefficients (parcors) using recursion, computing $M_{nb}$ area coefficients from the partial correlation coefficient, and extracting $M_{wb}$ area coefficients using interpolation. Wideband parcors are computed from the $M_{wb}$ area coefficients and wideband LPCs are computed from the wideband parcors. The method further comprises synthesizing a wideband signal using the wideband LPCs and a wideband excitation signal, highpass filtering the synthesized wideband signal to produce a highband signal, and combining the highband signal with the original narrowband signal to generate a wideband signal. In a preferred variation of the invention, the $M_{nb}$ area coefficients are converted to log-area coefficients for the purpose of extracting, through shifted-interpolation, $M_{wb}$ log-area coefficients. The $M_{wb}$ log-area coefficients are then converted to $M_{wb}$ area coefficients before generating the wideband parcors.

18 Claims, 20 Drawing Sheets

U.S. PATENT DOCUMENTS

| | | | | |
|---|---|---|---|---|
| 6,813,335 | B2 | 11/2004 | Shinbata | |
| 6,895,375 | B2 | 5/2005 | Malah et al. | |
| 7,317,309 | B2 * | 1/2008 | Yamaguchi et al. | 324/76.19 |
| 2001/0044722 | A1 * | 11/2001 | Gustafsson et al. | 704/258 |
| 2002/0193988 | A1 * | 12/2002 | Chennoukh et al. | 704/205 |

FOREIGN PATENT DOCUMENTS

JP 01292400 11/1989

OTHER PUBLICATIONS

Atal, B.S. et al., "Speech Analysis and Synthesis by Linear Prediction of the SpeechWave", Journal of the Acoustical Society of America, American Institute of Physics, New York, US, vol. 50, No. 2, Jan. 1971, pp. 637-655.
Valimaki et al., "Articulartory Control of a Vocal Tract Model Based on Fractional Delay Waveguide Filters", Speech, Image Processing and Neural Networks, 1994. Proceedings, ISSIPNN '94, 1994 Intl. Symposium on Hong Kong, Apr. 13-16, 1994, New York, NY, USA, IEEE, Apr. 13, 1994, pp. 571-574.
Nakatoh, Y. et al., "Generation of Broadband Speech from Narrowband Speech Using Piecewise Linear Mapping", Proc. European Conf. Speech Comm. and Technology, EUROSPEECH '97, 1997.
Cheng, Y.M. et al., "Statistical Recovery of Wideband Speech from Narrowband Speech," IEEE Trans. Speech and Audio Processing, vol. 2, No. 4, pp. 544-548, Oct. 1994.
Carl, H. et al., "Bandwidth Enhancement of Narrow-Band Speech Signals", Proc. European Signal Processing Conf.—EUSIPCO '94, pp. 1178-1181, 1994.
Yoshida, Y., "An Algorithm to Reconstruct Wideband Speech from Narrowband Speech Based on Codebook Mapping," Proc. Intl. Conf. Spoken Language Processing, ICSLP '94, 1994.
Yasukawa, H. "Quality Enhancement of Band Limited Speech by Filtering and Multi-rate Techniques," Proc. Intl. Conf. Spoken Language Processing, ICSLP '94, 1994, pp. 1607-1610.
Hermansky, H. et al., "Speech Enhancement Based on Temporal Processing," Proc. Intl. Conf. Acoust., Speech, Signal Processing, ICASSP '95, pp. 405-408, 1995.
Yasukawa, H., "Enhancement of Telephone Speech Quality by Simple Spectrum Extrapolation Method", Proc. European Conf. Speech Comm. and Technology, EUROSPEECH '95, 1995.
Yasukawa, H. "Adaptive Filtering for Broad Band Signal Reconstruction Using Spectrum Extrapolation," Proc. IEEE Digital Signal Processing Workshop, pp. 169-172, 1996.
Yasukawa, H. "Restoration of Wide Band Signal from Telephone Speech Using Linear Prediction Residual Error Filtering," Proc. IEEE Digital Signal Processing Workshop, pp. 176-178, 1996.
Yasukawa, H. "Implementation of Frequency Domain Digital Filter for Speech Enhancement", Proc. Intl. Conf. Electronics, Circuits and Systems, ICECS '96, pp. 518-521, 1996.
Yasukawa , H. "Signal Restoration of Broad Band Speech Using Nonlinear Processing", Proc. European Conf. Speech Comm. and Technology, EUROSPEECH '96, pp. 987-990, 1996.
Yasukawa, H. "Wideband Speech Recovery from Bandlimited Speech in Telephone Communications," Proc. Intl. Symp. Circuits and Systems, ISCAS '98, pp. IV-202-IV-205, 1998.
Epps, J. et al., "A New Technique for Wideband Enhancement of Coded Narrowband Speech", Proc. IEEE Speech Coding Workshop, SCW '99, 1999.
Enbom, N. et al., "Bandwidth Expansion of Speech Based on Vector Quantization of the Mel Frequency Cepstral Coefficients," Proc. IEEE Speech Coding Workshop, SCW '99, 1999.
Jax, P. et al., "Wideband Extension of Telephone Speech Using a Hidden Markov Model", Proc. IEEE Speech Coding Workshop, SCW '00, 2000.
Valin, J-M. et al., "Bandwidth Extension of Narrowband Speech for Low Bit-Rate Wideband Coding," Proc. IEEE Speech Coding Workshop, SCW '00, 2000.
Park et al., K-Y et al., "Narrowband to Wideband Conversion of Speech Using GMM Based Transformation", Proc. Intl. Conf. Acoust., Speech, Signal Processing, ICASSP '00, pp. 1843-1846, 2000.
Miet, G. et al., "Low-Band Extension of Telephone-Band Speech." Proc. Intl. Conf. Acoust., Speech, Signal Processing, ICASSP '00, pp. 1851-1854, 2000.
Chennoukh, S. et al., "Speech Enhancement Via Frequency Bandwidth Extension Using Line Spectral Frequencies", Proc. Intl. Conf. Acoust., Speech, Signal Processing, ICASSP '01, 2001.
Uncini, A. et al., "Frequency Recovery of Narrow-Band Speech Using Adaptive Spline Neutral Networks," Proc. Intl. Conf. Acoust., Speech, Signal Processing, ICASSP '99, 1999.
McCree, A., "A 14 kb/s Wideband Speech Coder with a Parametric Highband Model," Proc. Intl. conf. Acoust., Speech, Signal Processing, ICASSP '00, pp. 1153-1156, 2000.
Taori, R., "Hi-Bin: An Alternative Approach to Wideband Speech Coding", Proc. Intl. Conf. Acoust., Speech, Signal Processing, ICASSP '00, pp. 1157-1160, 2000.
McCree, A., "An Embedded Adaptive Multi-rate Wideband Speech Coder", Proc. Intl. Conf. Acoust., Speech, Signal Processing, ICASSP '01, 2001.
Erdmann, C., "A Candidate Proposal for a 3GPP Adaptive Multi-Rate Wideband Speech Coded," Proc. Intl. Conf. Acoust., Speech, Signal Processing, ICASSP '01, 2001.
Makhoul, J. et al., "High-Frequency Regeneration in Speech Coding Systems," Proc. Intl. Conf. Acoust., Speech, Signal Processing, ICASSP '79, pp. 428-431, 1979.
Wakita, H., "Direct Estimation of the vocal Tract Shape by Inverse Filtering of Acoustic Speech Waveforms," IEEE Trans. Audio and Electroacoust., vol. AU-21, No. 5, pp. 417- 427, Oct. 1973.
Wakita, H., "Estimation of Vocal-Tract Shapes from Acoustical Analysis of the Speech Wave: The State of the Art," IEEE Trans. Acoustics, Speech, Signal Processing, vol. ASSP-27, No. 3, pp. 281-285, Jun. 1979.
Schroeder, M.R., "Determination of the Geometry of the Human Vocal Tract by Acoustic Measurements", Journal Acoust. Soc. Am., vol. 41, No. 4, (Part 2), 1967.
Schroeter, J. et al., "Techniques for Estimating Vocal-Tract Shapes from the Speech Signal," IEEE Trans. Speech and Audio Processing, vol. 2, No. 1, Part II, pp. 133-150, Jan. 1994.
Baharav, Z. et al., "Hierarchical Interpretation of Fractal Image Coding and Its Applications," Chapter 5, Y. Fisher, Ed., Fractual Image Compression: Theory and Applications to Digital Images, Springer-Verlag, New York, 1995, pp. 97-117.
Avendano, C., "Beyond Nyquist: Towards the Recovery of Broad-Bandwidth Speech from Narrow-Bandwidth Speech," proc. European Conf. Speech Comm. and Technology, EUROSPEECH '95, pp. 165-168, Madrid, Spain 1995.
Chan, C-F., "Wideband Re-Synthesis of Narrowband Celp-Coded Speech Using Multiband Excitation Model," Proc. Intl. Conf. Spoken Language Processing, ICSLP '96, pp. 322-325, 1996.
Epps, J., "Wideband Extension of Narrowband Speech for Enhancement and Coding," School of Electrical Engineering and Telecommunications, The University of New South Wales, Sep. 2000, pp. 1-155.

* cited by examiner

SYSTEM FOR BANDWIDTH EXTENSION OF NARROW-BAND SPEECH

PRIORITY CLAIM

The present application claims priority to U.S. patent application Ser. No. 11/113,463, filed Apr. 25, 2005, which claims priority to U.S. patent application Ser. No. 09/971,375, filed Oct. 4, 2001, now U.S. Pat. No. 6,895,375, the contents of which are incorporated herein by reference.

RELATED APPLICATION

The present application is related to U.S. patent application Ser. No. 09/970,743, filed Oct. 4, 2001, now U.S. Pat. No. 6,988,066, invented by David Malah. The contents of the related patent are incorporated herein by reference.

BACKGROUND OF THE INVENTION

1. Field of the Invention

The present invention relates to enhancing the crispness and clarity of narrowband speech and more specifically to an approach of extending the bandwidth of narrowband speech.

2. Discussion of Related Art

The use of electronic communication systems is widespread in most societies. One of the most common forms of communication between individuals is telephone communication. Telephone communication may occur in a variety of ways. Some examples of communication systems include telephones, cellular phones, Internet telephony and radio communication systems. Several of these examples—Internet telephony and cellular phones—provide wideband communication but when the systems transmit voice, they usually transmit at low bit-rates.

Limits of the capacity of existing telecommunications infrastructure have seen huge investments in its expansion and adoption of newer wider bandwidth technologies. Demand for more mobile convenient forms of communication is also seen in increase in the development and expansion of cellular and satellite telephones, both of which have capacity constraints. In order to address these constraints, bandwidth extension research is ongoing to address the problem of accommodating more users over such limited capacity media by compressing speech before transmitting it across a network.

Wideband speech is typically defined as speech in the 7 to 8 kHz bandwidth, as opposed to narrowband speech, which is typically encountered in telephony with a bandwidth of less than 4 kHz. The advantage in using wideband speech is that it sounds more natural and offers higher intelligibility. Compared with normal speech, bandlimited speech has a muffled quality and reduced intelligibility, which is particularly noticeable in sounds such as /s/, /f/ and /sh/. In digital connections, both narrowband speech and wideband speech are coded to facilitate transmission of the speech signal. Coding a signal of a higher bandwidth requires an increase in the bit rate. Therefore, much research still focuses on reconstructing high-quality speech at low bit rates just for 4 kHz narrowband applications.

In order to improve the quality of narrowband speech without increasing the transmission bit rate, wideband enhancement involves synthesizing a highband signal from the narrowband speech and combining the highband signal with the narrowband signal to produce a higher quality wideband speech signal. The synthesized highband signal is based entirely on information contained in the narrowband speech. Thus, wideband enhancement can potentially increase the quality and intelligibility of the signal without increasing the coding bit rate. Wideband enhancement schemes typically include various components such as highband excitation synthesis and highband spectral envelope estimation. Recent improvements in these methods are known such as the excitation synthesis method that uses a combination of sinusoidal transform coding-based excitation and random excitation and new techniques for highband spectral envelope estimation. Other improvements related to bandwidth extension include very low bit rate wideband speech coding in which the quality of the wideband enhancement scheme is improved further by allocating a very small bitstream for coding the highband envelope and the gain. These recent improvements are explained in further detail in the PhD. Thesis "Wideband Extension of Narrowband Speech for Enhancement and Coding", by Julien Epps, at the School of Electrical Engineering and Telecommunications, the University of New South Wales, and found on the Internet at: http://www.library.unsw.edu.au/~thesis/adt-NUN/public/adt-NUN20001018.155146/. Related published papers to the Thesis are J. Epps and W. H. Holmes, Speech Enhancement using STC-Based Bandwidth Extension, in Proc. Intl. Conf. Spoken Language Processing, ICSLP '98, 1998; and J. Epps and W. H. Holmes, A New Technique for Wideband Enhancement of Coded Narrowband Speech, in Proc. IEEE Speech Coding Workshop, SCW '99, 1999. The contents of this Thesis and published paper are incorporated herein for background material.

A direct way to obtain wideband speech at the receiving end is to either transmit it in analog form or use a wideband speech coder. However, existing analog systems, like the plain old telephone system (POTS), are not suited for wideband analog signal transmission, and wideband coding means relatively high bit rates, typically in the range of 16 to 32 kbps, as compared to narrowband speech coding at 1.2 to 8 kbps. In 1994, several publications have shown that it is possible to extend the bandwidth of narrowband speech directly from the input narrowband speech. In ensuing works, bandwidth extension is applied either to the original or to the decoded narrowband speech, and a variety of techniques that are discussed herein were proposed.

Bandwidth extension methods rely on the apparent dependence of the highband signal on the given narrowband signal. These methods further utilize the reduced sensitivity of the human auditory system to spectral distortions in the upper or high band region, as compared to the lower band where on average most of the signal power exists.

Most known bandwidth extension methods are structured according to one of the two general schemes shown in FIGS. 1A and 1B. The two structures shown in these figures leave the original signal unaltered, except for interpolating it to the higher sampling frequency, for example, 16 kHz. This way, any processing artifacts due to re-synthesis of the lower-band signal are avoided. The main task is therefore the generation of the highband signal. Although, when the input speech passes through the telephone channel it is limited to the frequency band of 300-3400 Hz and there could be interest in extending it also down to the low-band of 0 to 300 Hz. The difference between the two schemes shown in FIGS. 1A and 1B is in their complexity. Whereas in FIG. 1B, signal interpolation is done only once, in FIG. 1A an additional interpolation operation is typically needed within the highband signal generation block.

In general, when used herein, "S" denotes signals, fs denotes sampling frequencies, "nb" denotes narrowband, "wb" denotes wideband "bb" denotes highband, and "~" stands for "interpolated narrowband."

As shown in FIG. 1A the system 10 includes a highband generation module 12 and a 1:2 interpolation module 14 that receive in parallel the signal $S_{nb}$, as input narrowband speech. The signal $\tilde{S}_{nb}$ is produced by interpolating the input signal by a factor of two, that is, by inserting a sample between each pair of narrowband samples and determining its amplitude based on the amplitudes of the surrounding narrowband samples via lowpass filtering. However, there is weakness in the interpolated speech in that it does not contain any high frequencies. Interpolation merely produces 4 kHz bandlimited speech with a sampling rate of 16 kHz rather than 8 kHz. To obtain a wideband signal, a highband signal $S_{hb}$ containing frequencies above 4 kHz needs to be added to the interpolated narrowband speech to form a wideband speech signal $\hat{S}_{wb}$. The highband generation module 12 produces the signal $S_{hb}$ and the 1:2 interpolation module 14 produces the signal, $\tilde{S}_{nb}$. These signals are summed 16 to produce the wide band signal $\hat{S}_{wb}$.

FIG. 1B illustrates another system 20 for bandwidth extension of narrowband speech. In this figure, the narrowband speech $S_{nb}$, sampled at 8 kHz, is input to an interpolation module 24. The output from interpolation module 24 is at a sampling frequency of 16 kHz. The signal is input to both a highband generation module 22 and a delay module 26. The output from the highband generation module 22 $S_{hb}$ and the delayed signal output from the delay module 26, $\tilde{S}_{nb}$ are summed up 28 to produce a wideband speech signal $\hat{S}_{wb}$ at 16 kHz.

Reported bandwidth extension methods can be classified into two types—parametric and non-parametric. Non-parametric methods usually convert directly the received narrowband speech signal into a wideband signal, using simple techniques like spectral folding, shown in FIG. 2A, and nonlinear processing shown in FIG. 2B.

These non-parametric methods extend the bandwidth of the input narrowband speech signal directly, i.e., without any signal analysis. since a parametric representation is not needed. The mechanism of spectral folding to generate the highband signal, as shown in FIG. 2A, involves upsampling 36 by a factor of 2 by inserting a zero sample following each input sample, highpass filtering with additional spectral shaping 38, and gain adjustment 40. Since the spectral folding operation reflects formants from the lower band into the upper band, i.e., highband, the purpose of the spectral shaping filter is to attenuate these signals in the highband. To reduce the spectral-gap about 4 kHz, which appears in spectrally folded telephone-bandwidth speech, a multirate technique is suggested as is known in the art. See, e.g., H. Yasukawa, Quality Enhancement of Band Limited Speech by Filtering and Multirate Techniques, in Proc. Intl. Conf. Spoken Language Processing, ICSLP '94, pp. 1607-1610, 1994; and H. Yasukawa, Enhancement of Telephone Speech Quality by Simple Spectrum Extrapolation Method, in Proc. European Conf. Speech Comm. and Technology, Eurospeech –95, 1995.

The wideband signal is obtained by adding the generated highband signal to the interpolated (1:2) input signal, as shown in FIG. 1A. This method suffers by failing to maintain the harmonic structure of voiced speech because of spectral folding. The method is also limited by the fixed spectral shaping and gain adjustment that may only be partially corrected by an adaptive gain adjustment.

The second method, shown in FIG. 2B, generates a highband signal by applying nonlinear processing 46 (e.g., waveform rectification) after interpolation (1:2) 44 of the narrowband input signal. Preferably, fullwave rectification is used for this purpose. Again, highpass and spectral shaping filters 48 with a gain adjustment 50 are applied to the rectified signal to generate the highband signal. Although a memoryless nonlinear operator maintains the harmonic structure of voiced speech, the portion of energy 'spilled over' to the highband and its spectral shape depends on the spectral characteristics of the input narrowband signal, making it difficult to properly shape the highband spectrum and adjust the gain.

The main advantages of the non-parametric approach are its relatively low complexity and its robustness, stemming from the fact that no model needs to be defined and, consequently, no parameters need to be extracted and no training is needed. These characteristics, however, typically result in lower quality when compared with parametric methods.

Parametric methods separate the processing into two parts as shown in FIG. 3. A first part 54 generates the spectral envelope of a wideband signal from the spectral envelope of the input signal, while a second part 56 generates a wideband excitation signal, to be shaped by the generated wideband spectral envelope 58. Highpass filtering and gain 60 extract the highband signal for combining with the original narrowband signal to produce the output wideband signal. A parametric model is usually used to represent the spectral envelope and, typically, the same or a related model is used in 58 for synthesizing the intermediate wideband signal that is input to block 60.

Common models for spectral envelope representation are based on linear prediction (LP) such as linear prediction coefficients (LPC) and line spectral frequencies (LSF), cepsral representations such as cepstral coefficients and mel-frequency cepstral coefficients (MFCC), or spectral envelope samples, usually logarithmic, typically extracted from an LP model. Almost all parametric techniques use an LPC synthesis filter for wideband signal generation (typically an intermediate wideband signal which is further highpass filtered), by exciting it with an appropriate wideband excitation signal.

Parametric methods can be further classified into those that require training, and those that do not and hence are simpler and more robust. Most reported parametric methods require training, like those that are based on vector quantization (VQ), using codebook mapping of the parameter vectors or linear, as well as piecewise linear, mapping of these vectors. Neural-net-based methods and statistical methods also use parametric models and require training.

In the training phase, the relationship or dependence between the original narrowband and highband (or wideband) signal parameters is extracted. This relationship is then used to obtain an estimated spectral envelope shape of the highband signal from the input narrowband signal on a frame-by-frame basis.

Not all parametric methods require training. A method that does not require training is reported in H. Yasukawa, Restoration of Wide Band Signal from Telephone Speech Using Linear Prediction Error Processing, in Proc. Intl. Conf. Spoken Language Processing, ICSLP 1996, pp. 901-904 (the "Yasukawa Approach"). The contents of this article are incorporated herein by reference for background material. The Yasukawa Approach is based on the linear extrapolation of the spectral tilt of the input speech spectral envelope into the upper band. The extended envelope is converted into a signal by inverse DFT, from which LP coefficients are extracted and used for synthesizing the highband signal. The synthesis is carried out by exciting the LPC synthesis filter by a wideband excitation signal. The excitation signal is obtained by inverse filtering the input narrowband signal and spectral folding the resulting residual signal. The main disadvantage of this technique is in the rather simplistic approach for generating the highband spectral envelope just based on the spectral tilt in the lower band.

SUMMARY OF THE INVENTION

The present disclosure focuses on a novel and non-obvious bandwidth extension approach in the category of parametric methods that do not require training. What is needed in the art is a low-complexity but high quality bandwidth extension system and method. Unlike the Yasukawa Approach, the generation of the highband spectral envelope according to the present invention is based on the interpolation of the area (or log-area) coefficients extracted from the narrowband signal. This representation is related to a discretized acoustic tube model (DATM) and is based on replacing parameter-vector mappings, or other complicated representation transformations, by a rather simple shifted-interpolation approach of area (or log-area) coefficients of the DATM. The interpolation of the area (or log-area) coefficients provides a more natural extension of the spectral envelope than just an extrapolation of the spectral tilt. An advantage of the approach disclosed herein is that it does not require any training and hence is simple to use and robust.

A central element in the speech production mechanism is the vocal tract that is modeled by the DATM. The resonance frequencies of the vocal tract, called formants, are captured by the LPC model. Speech is generated by exciting the vocal tract with air from the lungs. For voiced speech the vocal cords generate a quasi-periodic excitation of air pulses (at the pitch frequency), while air turbulences at constrictions in the vocal tract provide the excitation for unvoiced sounds. By filtering the speech signal with an inverse filter, whose coefficients are determined form the LPC model, the effect of the formants is removed and the resulting signal (known as the linear prediction residual signal) models the excitation signal to the vocal tract.

The same DATM may be used for non-speech signals. For example, to perform effective bandwidth extension on a trumpet or piano sound, a discrete acoustic model would be created to represent the different shape of the "tube". The process disclosed herein would then continue with the exception of differently selecting the number of parameters and highband spectral shaping.

The DATM model is linked to the linear prediction (LP) model for representing speech spectral envelopes. The interpolation method according to the present invention affects a refinement of the DATM corresponding to a wideband representation, and is found to produce an improved performance. In one aspect of the invention, the number of DATM sections is doubled in the refinement process.

Other components of the invention, such as those generating the wideband excitation signal needed for synthesizing the highband signal and its spectral shaping, are also incorporated into the overall system while retaining its low complexity.

Embodiments of the invention relate to a system and method for extending the bandwidth of a narrowband signal. One embodiment of the invention relates to a wideband signal created according to the method disclosed herein.

A main aspect of the present invention relates to extracting a wideband spectral envelope representation from the input narrowband spectral representation using the LPC coefficients. The method comprises computing narrowband linear predictive coefficients LPC) $a^{nb}$ from the narrowband signal, computing narrowband partial correlation coefficients (parcors) $r_i$ associated with the narrowband LPCs and computing $M_{nb}$ area coefficients $A_i^{nb}$, i=1, 2, . . . , $M_{nb}$ using the following:

$$A_i = \frac{1 + r_i}{1 - r_i} A_{i+1};$$

i=$M_{nb}$, $M_{nb}$−1, . . . , 1, where $A_1$ corresponds to the cross-section at the lips, $A_{M^{nb}+1}$ corresponds to the cross-section at the glottis opening. Preferably, $M_{nb}$ is eight but the exact number may vary and is not important to the present invention. The method further comprises extracting $M_{wb}$ area coefficients from the $M_{nb}$ area coefficients using shifted-interpolation. Preferably, $M_{wb}$ is sixteen or double $M_{nb}$ but these ratios and number may vary and are not important for the practice of the invention. Wideband parcors are computed using the $M_{wb}$ area coefficients according to the following:

$$r_i^{wb} = \frac{A_i^{wb} - A_{i+1}^{wb}}{A_i^{wb} + A_{i+1}^{wb}}, \; i = 1, 2, \ldots, M_{wb}.$$

The method further comprises computing wideband LPCs $\alpha_i^{wb}$, i=1, 2, . . . , $M_{wb}$, from the wideband parcors and generating a highband signal using the wideband LPCs and an excitation signal followed by spectral shaping. Finally, the highband signal and the narrowband signal are summed to produce the wideband signal.

A variation on the method relates to calculating the log-area coefficients. If this aspect of the invention is performed, then the method further calculates log-area coefficients from the area coefficients using a process such as applying the natural-log operator. Then, $M_{wb}$ log-area coefficients are extracted from the $M_{nb}$ log-area coefficients. Exponentiation or some other operation is performed to convert the $M_{wb}$ log-area coefficients into $M_{wb}$ area coefficients before solving for wideband parcors and computing wideband LPC coefficients. The wideband parcors and LPC coefficients are used for synthesizing a wideband signal. The synthesized wideband signal is highpass filtered and summed with the original narrowband signal to generate the output wideband signal. Any monotonic nonlinear transformation or mapping could be applied to the area coefficients rather than using the log-area coefficients. Then, instead of exponentiation, an inverse mapping would be used to convert back to area coefficients.

Another embodiment of the invention relates to a system for generating a wideband signal from a narrowband signal. An example of this embodiment comprises a module for processing the narrowband signal. The narrowband module comprises a signal interpolation module producing an interpolated narrowband signal, an inverse filter that filters the interpolated narrowband signal and a nonlinear operation module that generates an excitation signal from the filtered interpolated narrowband signal. The system further comprises a module for producing wideband coefficients. The wideband coefficient module comprises a linear predictive analysis module that produces parcors associated with the narrowband signal, an area parameter module that computes area parameters from the parcors, a shifted-interpolation module that computes shift-interpolated area parameters from the narrowband area parameters, a module that computes wideband parcors from the shift-interpolated area parameters and a wideband LP coefficients module that computes LP wideband coefficients from the wideband parcors. A synthesis module receives the wideband coefficients and the wideband excitation signal to synthesize a wideband signal. A highpass filter and gain module filters the wideband signal and adjusts the gain of the resulting highband signal. A summer sums the synthesized highband signal and the narrowband signal to generate the wideband signal.

Any of the modules discussed as being associated with the present invention may be implemented in a computer device as instructed by a software program written in any appropriate high-level programming language. Further, any such module may be implemented through hardware means such as an application specific integrated circuit (ASIC) or a digital signal processor (DSP). Such a computer device includes a processor which is controlled by instructions in the software program written in the programming language. One of skill in the art will understand the various ways in which these functional modules may be implemented. Accordingly, no more specific information regarding their implementation is provided.

Another embodiment of the invention relates to a tangible computer-readable medium storing a program or instructions for controlling a computer device to perform the steps according to the method disclosed herein for extending the bandwidth of a narrowband signal. An exemplary embodiment comprises a computer-readable storage medium storing a series of instructions for controlling a computer device to produce a wideband signal from a narrowband signal. Such a tangible medium includes RAM, ROM, hard-drives and the like but excludes signals per se or wireless interfaces. The instructions may be programmed according to any known computer programming language or other means of instructing a computer device. The instructions include controlling the computer device to: compute partial correlation coefficients (parcors) from the narrowband signal; compute $M_{nb}$ area coefficients using the parcors, extract $M_{wb}$ area coefficients from the $M_{nb}$ area coefficients using shifted-interpolation; compute wideband parcors from the $M_{wb}$ area coefficients; convert the $M_{wb}$ area coefficients into wideband LPCs using the wideband parcors; synthesize a wideband signal using the wideband LPCs, and a wideband excitation signal generated from the narrowband signal; highpass filter the synthesized wideband signal to generate the synthesized highband signal; and sum the synthesized highband signal with the narrowband signal to generate the wideband signal.

Another embodiment of the invention relates to the wideband signal produced according to the method disclosed herein. For example, an aspect of the invention is related to a wideband signal produced according to a method of extending the bandwidth of a received narrowband signal. The method by which the wideband signal is generated comprises computing narrowband linear predictive coefficients (LPCs) from the narrowband signal, computing narrowband parcors using recursion, computing $M_{nb}$ area coefficients using the narrowband parcors, extracting $M_{wb}$ area coefficients from the $M_{nb}$ area coefficients using shifted-interpolation, computing wideband parcors using the $M_{wb}$ area coefficients, converting the wideband parcors into wideband LPCs, synthesizing a wideband signal using the wideband LPCs and a wideband residual signal, highpass filtering the synthesized wideband signal to generate a synthesized highband signal, and generating the wideband signal by summing the synthesized highband signal with the narrowband signal.

Wideband enhancement can be applied as a post-processor to any narrowband telephone receiver, or alternatively it can be combined with any narrowband speech coder to produce a very low bit rate wideband speech coder. Applications include higher quality mobile, teleconferencing, or Internet telephony.

BRIEF DESCRIPTION OF THE DRAWINGS

The present invention may be understood with reference to the attached drawings, of which.

DETAILED DESCRIPTION OF THE INVENTION

What is needed is a method and system for producing a good quality wideband signal from a narrowband signal that is efficient and robust. The various embodiments of the invention disclosed herein address the deficiencies of the prior art.

The basic idea relates to obtaining parameters that represent the wideband spectral envelope from the narrowband spectral representation. In a first stage according to an aspect of the invention, the spectral envelope parameters of the input narrowband speech are extracted 64 as shown in the diagram in FIG. 4. Various parameters have been used in the literature such as LP coefficients (LPC), line spectral frequencies (LSF), cepstral coefficients, mel-frequency cepstral coefficients (MFCC), and even just selected samples of the spectral (or log-spectral) magnitude usually extracted from an LP representation. Any method applicable to the area/log area may be used for extracting spectral envelope parameters. In the present invention, the method comprises deriving the area or log-area coefficients from the LP model.

Figure 4:
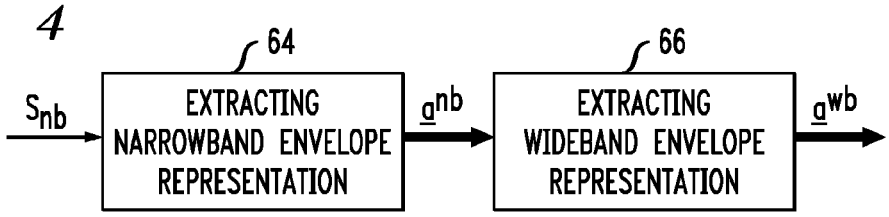
FIG. 4 shows a block diagram of the generation of a wideband envelope representation from a narrowband input signal.

Once the narrowband spectral envelope representation is found, the next stage, as seen in FIG. 4, is to obtain the wideband spectral envelope representation 66. As discussed above, reported methods for performing this task can be categorized into those requiring offline training, and those that do not. Methods that require training use some form of mapping from the narrowband parameter-vector to the wideband parameter-vector. Some methods apply one of the following: Codebook mapping, linear (or piecewise linear) mapping (both are vector quantization (VQ)-based methods), neural networks and statistical mappings such as a statistical recovery function (SRF). For more information on Vector quantization (VQ), see A. Gersho and R. M. Gray, Vector Quantization and Signal Compression, Kluwer, Boston, 1992. Training is needed for finding the correspondence between the narrowband and wideband parameters. In the training phase, wideband speech signals and the corresponding narrowband signals, obtained by lowpass filtering, are available so that the relationship between the corresponding parameter sets could be determined.

Some methods do not require training. For example, in the Yasukawa Approach discussed above, the spectral envelope of the highband is determined by a simple linear extension of the spectral tilt from the lower band to the highband. This spectral tilt is determined by applying a DFT to each frame of the input signal. The parametric representation is used then only for synthesizing a wideband signal using an LPC synthesis approach followed by highpass and spectral shaping filters. The method according to the present invention also belongs to this category of parametric with no training, but according to an aspect of the present invention, the wideband parameter representation is extracted from the narrowband representation via an appropriate interpolation of area (or log-area) coefficients.

To synthesize a wideband speech signal, having the above wideband spectral envelope representation, the latter is usually converted first to LP parameters. These LP parameters are then used to construct a synthesis filter, which needs to be excited by a suitable wideband excitation signal.

Figure 5A:
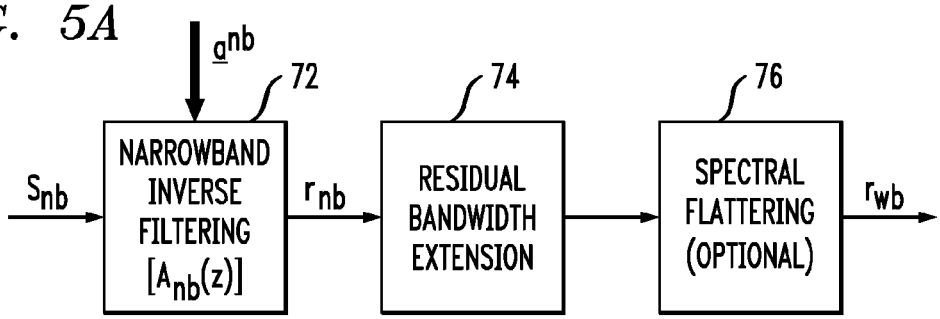
FIGS. 5A and 5B show alternate methods of generating a wideband excitation signal.
Figure 5B:
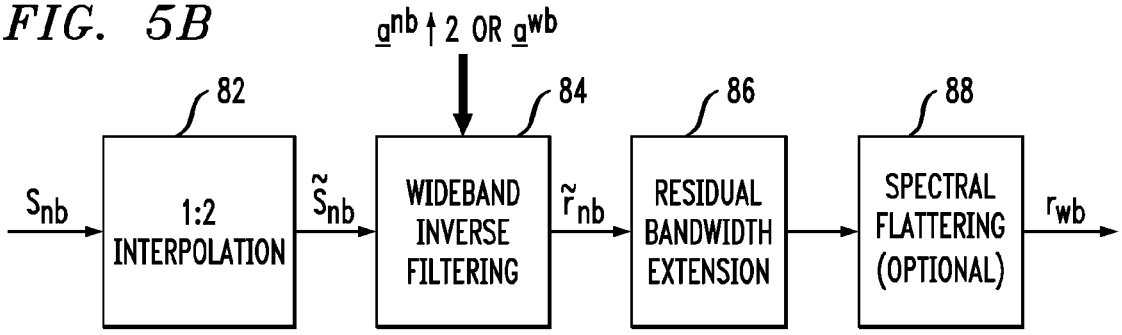

Two alternative approaches, commonly used for generating a wideband excitation signal, are depicted in FIGS. 5A and 5B. First, as shown in FIG. 5A, the narrowband input speech signal is inverse filtered 72 using previously extracted LP coefficients to obtain a narrowband residual signal. This is accomplished at the original low sampling frequency of, say, 8 kHz. To extend the bandwidth of the narrowband residual signal, either spectral folding (inserting a zero-valued sample following each input sample), or interpolation, such as 1:2 interpolation, followed by a nonlinear operation, e.g., full-wave rectification, are applied 74. Several nonlinear operators that are useful for this task are discussed at the end of this disclosure. Since the resulting wideband excitation signal may not be spectrally flat, a spectral flattening block 76 optionally follows. Spectral flattening can be done by applying an LPC analysis to this signal, followed by inverse filtering.

A second and preferred alternative is shown in FIG. 5B. It is useful for reducing the overall complexity of the system when a nonlinear operation is used to extend the bandwidth of the narrowband residual signal. Here, the already computed interpolated narrowband signal 82 (at, say, double the rate) is used to generate the narrowband residual, avoiding the need to perform the necessary additional interpolation in the first scheme. To perform the inverse filtering 84, the option exists in this case for either using the wideband LP parameters obtained from the mapping stage to get the inverse filter coefficients, or inserting zeros, like in spectral folding, into the narrowband LP coefficient vector. The latter option is equivalent to what is done in the first scheme (FIG. 5A) when a nonlinear operator is used, i.e., using the original LP coefficients for inverse filtering 72 the input narrowband signal followed by interpolation. The bandwidth of the resulting residual signal that is still narrowband but at the higher sampling frequency can now be extended 86 by a nonlinear operation, and optionally flattened 88 as in the first scheme.

An aspect of the present invention relates to an improved system for accomplishing bandwidth extension. Parametric bandwidth extension systems differ mostly in how they generate the highband spectral envelope. The present invention introduces a novel approach to generating the highband spectral envelope and is based on the fact that speech is generated by a physical system, with the spectral envelope being mainly determined by the vocal tract. Lip radiation and glottal wave shape also contribute to the formation of sound but pre-emphasizing the input speech signal coarsely compensates their effect. See, e.g., B. S. Atal and S. L. Hanauer, Speech Analysis and Synthesis by Linear Prediction of the Speech Wave, Journal Acoust. Soc. Am., Vol. 50, No.2, (Part 2), pp. 637-655, 1971; and H. Wakita Direction Estimation of the Vocal Tract Shape by Inverse Filtering of Acoustic Speech Waveform IEEE Trans. Audio and Electroacoust., vol. AU-21, No. 5, pp. 417-427, Oct. 1973 ("Wakita J"). The effect of the glottal wave shape can be further reduced if the analysis is done on a portion of the waveform corresponding to the time interval in which the glottis is closed. See, e.g., H. Wakita, Estimation of Vocal-Tract Shapes from Acoustical Analysis of the Speech Wave: The State of the Art IEEE Trans. Acoustics, Speech Signal Processing, Vol. ASSP-27, No. 3, pp. 281-285, June 1979 ("Wakita H."). The contents of Wakita I. and Wakita II are incorporated herein by reference. Such an analysis is complex and not considered the best mode of practicing the present invention, but may be employed in a more complex aspect of the invention.

Both the narrowband and wideband speech signals result from the excitation of the vocal tract. Hence, the wideband signal may be inferred from a given narrowband signal using information about the shape of the vocal tract and this information helps in obtaining a meaningful extension of the spectral envelope as well.

Figure 6:
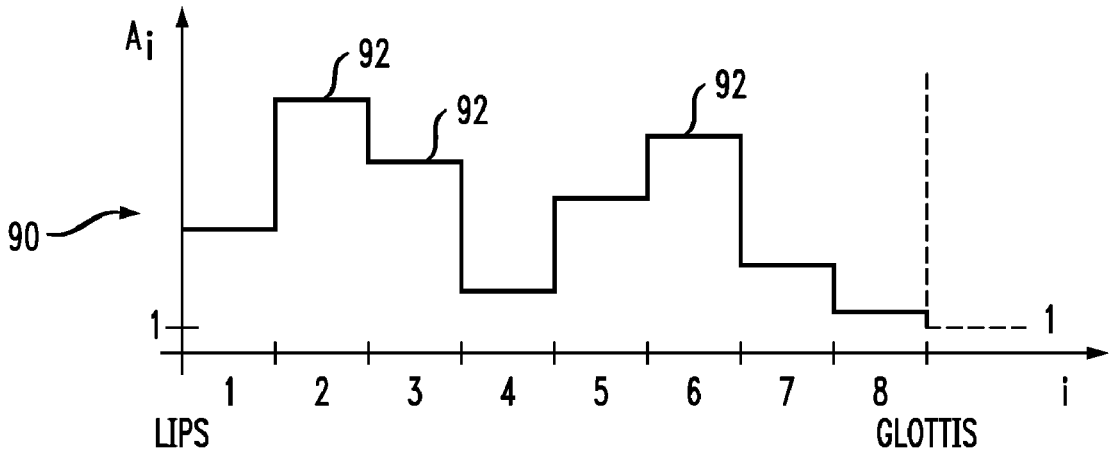
FIG. 6 shows an example discrete acoustic tube model (DATM)

It is well known that the linear prediction LP) model for speech production is equivalent to a discrete or sectioned nonuniform acoustic tube model constructed from uniform cylindrical rigid sections of equal length, as schematically shown in FIG. 6. Moreover, an equivalence of the filtering process by the acoustic tube and by the LP all-pole filter model of the pre-emphasized speech has been shown to exist under the constraint:

$$M = f_s \frac{2L}{c}. \tag{1}$$

In equation (1), M is the number of sections in the discrete acoustic tube model, $f_s$ is the sampling frequency (in Hz), c is the sound velocity (in m/sec), and L is the tube length (in m). For the typical values of c=340 m/sec, L=17 cm, and a sampling frequency of $f_s$=8 kHz, a value of M=8 sections is obtained, while for $f_s$=16 kHz, the equivalence holds for M=16 sections, corresponding to LPC models with 8 and 16 coefficients, respectively. See, e.g., Wakita I referenced above and J. D. Markel and A. H. Gray, Jr., Linear Prediction of Speech, Springer-Verlag, New York, 1976. Chapter 4 of Markel and Gray are incorporated herein by reference for background material.

The parameters of the discrete acoustic tube model (DATM) are the cross-section areas 92, as shown in FIG. 6. The relationship between the LP model parameters and the area parameters of the DATM are given by the backward recursion:

$$A_i = \frac{1 + r_i}{1 - r_i} A_{i+1};\ i = M_{nb}, M_{nb} - 1, \ldots, 1, \tag{2}$$

where $A_1$ corresponds to the cross-section at the lips and $A_{M^{nb}}+1$ corresponds to the cross-section at the glottis opening. $A_{M^{nb}}+1$ can be arbitrarily set to 1 since the actual values of the area function are not of interest in the context of the invention, but only the ratios of area values of adjacent sections. These ratios are related to the LP parameters, expressed here in terms of the reflection coefficients $r_i$, or "parcors." As mentioned above, the LP model parameters are obtained from the pre-emphasized input speech signal to compensate for the glottal wave shape and lip radiation. Typically, a fixed pre-emphasis filter is used, usually of the form $1-\mu z^{-1}$, where $\mu$ is chosen to affect a 6 dB/octave emphasis. According to the invention, it is preferable to use an adaptive pre-emphasis, by letting $\mu$ equal to the 1st normalized autocorrelation coefficient: $\mu=\rho_1$ in each processed frame.

Under the constraint in equation (1), for narrowband speech sampled at $f_s$=8 kHz, the number of area coefficients 92 (or acoustic tube sections) is chosen to be $M_{nb}$=8. FIG. 6 illustrates the eight area coefficients 92. Any number of area coefficients may be used according to the invention. To extend the signal bandwidth by a factor of 2, the problem at hand is how to obtain $M_{wb}$=16 area coefficients 100, from the given 8 coefficients 92, constituting a refined description of the vocal tract and thus providing a wideband spectral envelope representation. There is no way to find the set of 16 area coefficients 100 that would result from the analysis of the original wideband speech signal from which the narrowband signal was extracted by lowpass filtering. Using the approach according to the present invention, one can find a refinement as demonstrated in FIG. 7 that will correspond to a subjectively meaningful extended-bandwidth signal.

Figure 7:
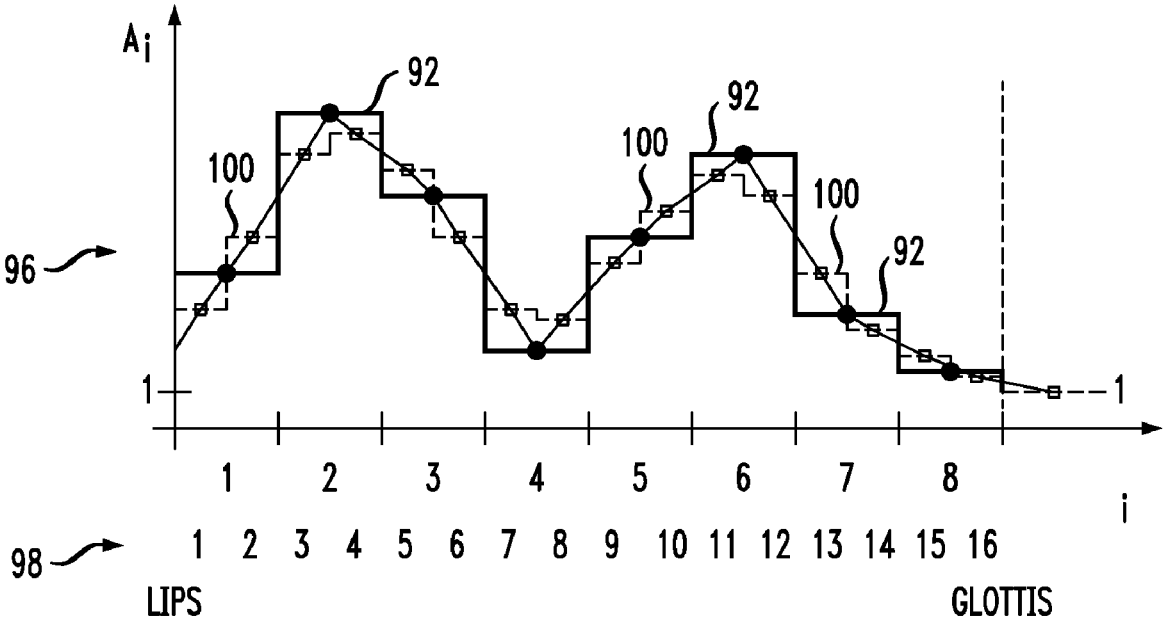
FIG. 7 illustrates an aspect of the present invention by refining the DATM by linear shifted-interpolation.

By maintaining the original narrowband signal, only the highband part of the generated wideband signal will be synthesized. In this regard, the refinement process tolerates distortions in the lower band part of the resulting representation. Based on the equal-area principle stated in Wakita, each uniform section in the DATM 92 should have an area that is equal (or proportional, because of the arbitrary selection of the value of $A_{M^{nb}}+1$) to the mean area of an underlying continuous area function of a physical vocal tract. Hence, doubling the number of sections corresponds to splitting each section into two in such a way that, preferably, the mean value of their areas equals the area of the original section. FIG. 7 includes example sections 92, with each section doubled 100 and labeled with a line of numbers 98 from 1 to 16 on the horizontal axis. The number of sections after division is related the ratio of $M_{wb}$ coefficients to $M_{nb}$ coefficients according to the desired bandwidth increase factor. For example, to double the bandwidth, each section is divided in two such that $M_{wb}$ is two times $M_{nb}$. To obtain 12 coefficients, an increase of 1.5 times the original bandwidth, then the process involves interpolating and then generating 12 sections of equal width such that the bandwidth increases by 1.5 times the original bandwidth.

The present invention comprises obtaining a refinement of the DATM via interpolation. For example, polynomial interpolation can be applied to the given area coefficients followed by re-sampling at the points corresponding to the new section centers. Because the re-sampling is at points that are shifted by a ¼ of the original sampling interval, we call this process shifted-interpolation. In FIG. 7 this process is demonstrated for a first order polynomial, which may be referred to as either 1st order, or linear, shifted-interpolation.

Such a refinement retains the original shape but the question is will it also provide a subjectively useful refinement of the DATM, in the sense that it would lead to a useful bandwidth extension. This was found to be case largely due to the reduced sensitivity of the human auditory system to spectral envelope distortions in the high band.

The simplest refinement considered according to an aspect of the present invention is to use a zero-order polynomial, i.e., splitting each section into two equal area sections (having the same area as the original section). As can be understood from equation (2), if $A_i=A_{i+1}$, then $r_i=0$. Hence, the new set of 16 reflection coefficients has the property that every other coefficient has zero value, while the remaining 8 coefficients are equal to the original (narrowband) reflection coefficients. Converting these coefficients to LP coefficients, using a known Step-Up procedure that is a reversal of order in the Levinson-Durbin recursion, results in a zero value of every other LP coefficient as well, i.e., a spectrum folding effect. That is, the bandwidth extended spectral envelope in the highband is a reflection or a mirror image, with respect to 4 kHz, of the original narrowband spectral envelope. This is certainly not a desired result and, if at all, it could have been achieved simply by direct spectral folding of the original input signal.

By applying higher order interpolation, such as a 1st order (linear) and cubic-spline interpolation, subjectively meaningful bandwidth extensions may be obtained. The cubic-spline interpolation is preferred, although it is more complex. In another aspect of the present invention, fractal interpolation was used to obtain similar results. Fractal interpolation has the advantage of the inherent property of maintaining the mean value in the refinement or super-resolution process. See, e.g., Z. Baharav, D. Malah, and E. Karnin, Hierarchical Interpretation of Fractal Image Coding and its Applications, Ch. 5 in Y. Fisher, Ed., Fractal Image Compression: Theory and Applications to Digital Images, Springer-Verlag, New York, 1995, pp. 97-117. The contents of this article are incorporated herein by reference as background material. Any interpolation process that is used to obtain refinement of the data is considered as within the scope of the present invention.

Another aspect of the present invention relates to applying the shifted-interpolation to the log-area coefficients. Since the log-area function is a smoother function than the area function because its periodic expansion is band-limited, it is beneficial to apply the shifted-interpolation process to the log-area coefficients. For information related to the smoothness property of the log-area coefficient, see, e.g., M. R. Schroeder, Determination of the Geometry of the Human Vocal Tract by Acoustic Measurements, Journal Acoust. Soc. Am. vol. 41, No. 4, (Part 2), 1967.

Figure 8:
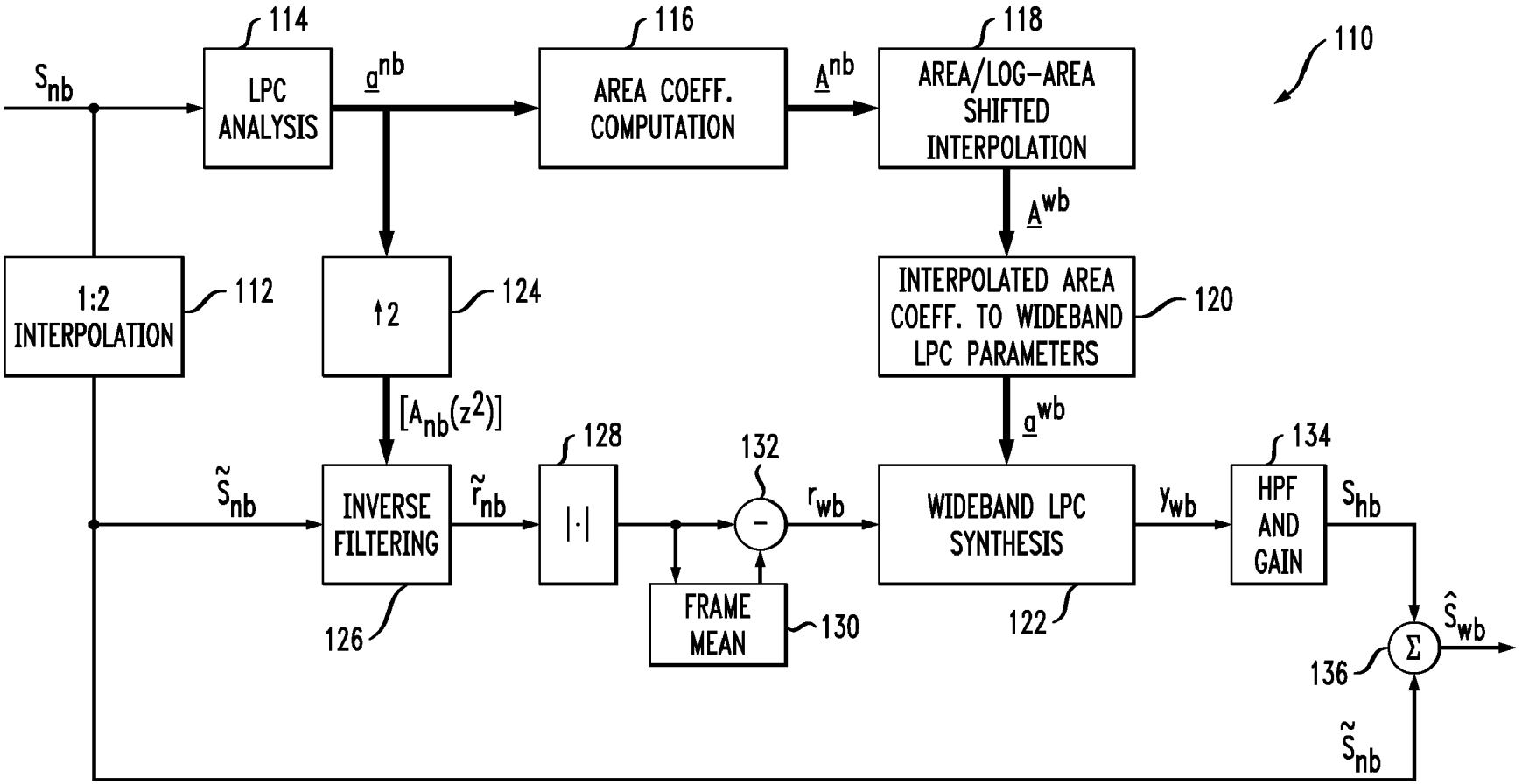
FIG. 8 illustrates a system block diagram for bandwidth extension according to an aspect of the present invention.

A block diagram of an illustrative bandwidth extension system 110 is shown in FIG. 8. It applies the proposed shifted-interpolation approach for DATM refinement and the results of the analysis of several nonlinear operators. These operators are useful in generating a wideband excitation signal.

In the diagram of FIG. 8, the input narrowband signal, $S_{nb}$, sampled at 8 kHz is fed into two branches. The 8 kHz signal is chosen by way of example assuming telephone bandwidth speech input. In the lower branch it is interpolated by a factor of 2 by upsampling 112, for example, by inserting a zero sample following each input sample and lowpass filtering at 4 kHz, yielding the narrowband interpolated signal $\tilde{S}_{nb}$. The symbol "~" relates to narrowband interpolated signals. Because of the spectral folding caused by upsampling, high energy formants at low frequencies, typically present in voiced speech, are reflected to high frequencies and need to be strongly attenuated by the lowpass filter (not shown). Otherwise, relatively strong undesired signals may appear in the synthesized highband.

Figure 9:
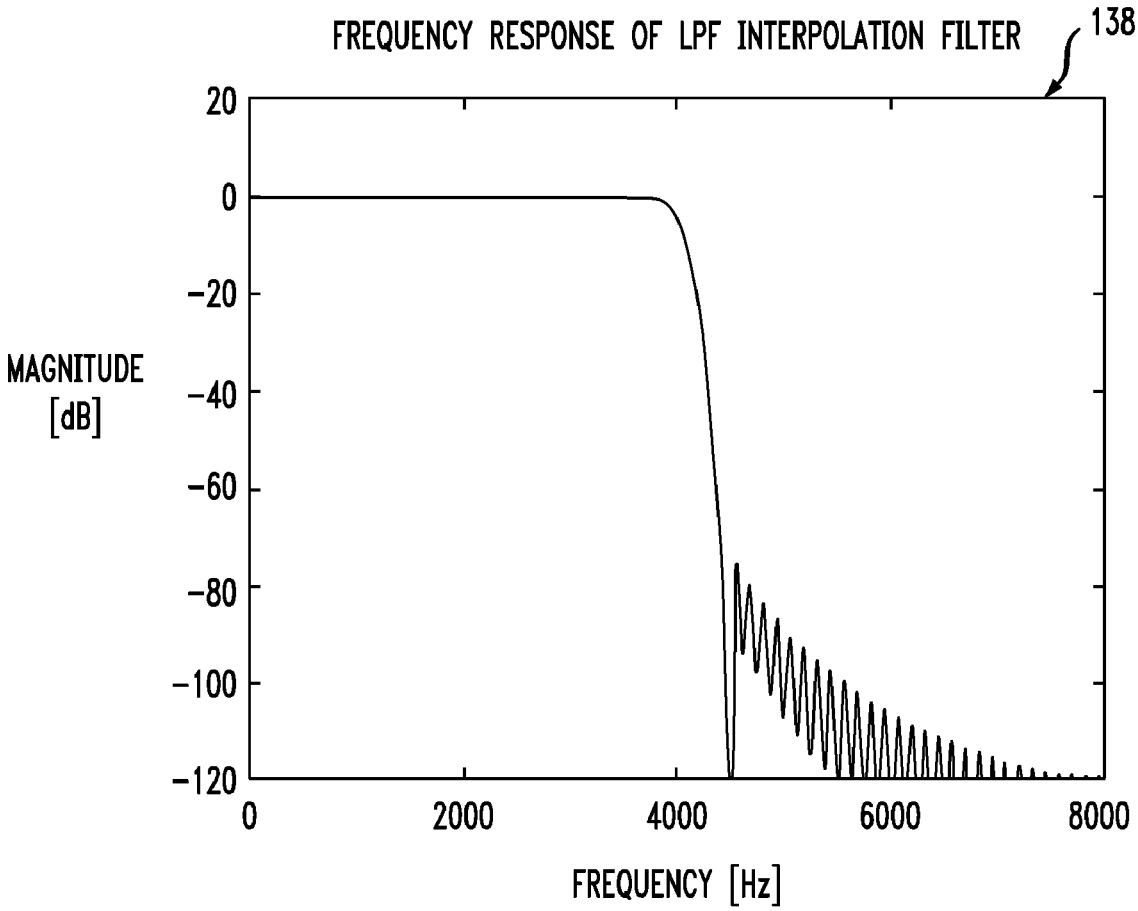
FIG. 9 shows the frequency response of a low pass interpolation filter.

Preferably, the lowpass filter is designed using the simple window method for FIR filter design, using a window function with sufficiently high sidelobes attenuation, like the Blackman window. See, e.g., B. Porat, A Course in Digital Signal processing, J. Wiley, New York, 1995. This approach has an advantage in terms of complexity over an equiripple design, since with the window method the attenuation increases with frequency, as desired here. The frequency response of a 129 long FIR lowpass filter designed with a Blackman window and used in simulations is shown in FIG. 9.

In the upper branch shown in FIG. 8, an LPC analysis module 114 analyzes $S_{nb}$, on a frame-by-frame basis. The frame length, N, is preferably 160 to 256 samples, corresponding to a frame duration of 20 to 32 msec. The analysis is preferably updated every half to one quarter frame. In the simulations described below, a value of N=256, with a half-frame update is used. The signal is first pre-emphasized using a first order FIR filter $1-\mu z^{-1}$, with $\mu=\rho_1$, where, as mentioned above, $\rho_1$ is the correlation coefficient, i.e., first normalized autocorrelation coefficient, adaptively computed for each analysis frame. The pre-emphasized signal frame is then windowed by a Hann window to avoid discontinuities at frame ends. The simpler autocorrelation method for deriving the LP coefficients was found to be adequate here. Under the constraint in equation (1), the model order is selected to be $M_{nb}=8$. As the result of the analysis, a vector $\underline{\alpha}^{nb}$ of 8 LPC coefficients is obtained for each frame. Thus, the functions explained in this paragraph are all performed by the LPC analysis module 114. The corresponding inverse filter transfer function is then given by $A_{nb}(z)$:

$$A_{nb}(z) = 1 + \sum_{i=1}^{M_{nb}} a_i^{nb} z^{-i} \tag{3}$$

However, to generate the LPC residual signal at the higher sampling rate ($f_s^{wb}$=16 kHz if fsnb=8 kHz), the interpolated signal $\tilde{S}_{nb}$ is inverse filtered by $A_{nb}(z^2)$, as shown by block 126. The filter coefficients, which are denoted by $\underline{\alpha}^{nb}\uparrow 2$, are simply obtained from $\underline{\alpha}^{nb}$ by upsampling by a factor of two 124, i.e., inserting zeros—as done for spectral folding. Thus, the coefficients of the inverse filter $A_{nb}(z^2)$, operating at the high sampling frequency, including the unity leading term, are:

$$\underline{\alpha}^{nb}\uparrow 2=\{1, 0, \alpha_1^{nb}, 0, \alpha_2^{nb}, 0, \ldots \alpha_{M^{nb}-1}^{nb}, 0\ \alpha_{M^{nb}}^{nb}\} \tag{4}$$

The resulting residual signal is denoted by $\bar{r}_{nb}$. It is a narrowband signal sampled at the higher sampling rate $f_s^{wb}$. As explained above with reference to FIG. 5B, this approach is preferred over either the scheme in FIG. 5A that requires more computations in the overall system or over the option in FIG. 5B that uses the wideband LPC coefficients, $\underline{\alpha}^{wb}$, extracted in another block 120 in the system 110. The latter is not chosen because in this system the use of $\underline{\alpha}^{wb}$, which is the result of the shifted-interpolation method, may affect the modeled lower band spectral envelope and hence the resulting residual signal may be less flat, spectrally. Note that any effect on the lower band of the model's response is not reflected at the output, because eventually the original narrowband signal is used.

A novel feature related to the present invention is the extraction of a wideband spectral envelope representation from the input narrowband spectral representation by the LPC coefficients $\underline{\alpha}^{nb}$. As explained above, this is done via the shifted-interpolation of the area or log-area coefficients. First, the area coefficients $A_i^{nb}$, i=1, 2, . . . , $M_{nb}$, not to be confused with $A_{nb}(z)$ in equ. (3), which denotes the inverse-filter transfer function, are computed 116 from the partial correlation coefficients parcors) of the narrowband signal, using equation (2) above. The parcors are obtained as a result of the computation process of the LPC coefficients by the Levinson Durbin recursion. See J. D. Markel and A. H. Gray, Jr., Linear Prediction of Speech, Springer-Verlag, New York, 1976; L. R. Rabiner and R. W. Schafer, Digital Processing of Speech Signals, Prentice Hall, N.J., 1978. If log-area coefficients are used, the natural-log operator is applied to the area coefficients. Any log function (to a finite base) may be applied according to the present invention since they retain the smoothness property. The refined number of area coefficients is set to, for example, $M_{wb}$=16 area (or log-area) coefficients. These sixteen coefficients are extracted from the given set of $M_{nb}$=8 coefficients by shifted-interpolation 118, as explained above and demonstrated in FIG. 7.

The extracted coefficients are then converted back to LPC coefficients, by first solving for the parcors from the area coefficients (if log-area coefficients are interpolated, exponentiation is used first to convert back to area coefficients), using the relation (from (2)):

$$r_i^{wb} = \frac{A_i^{wb} - A_{i+1}^{wb}}{A_i^{wb} + A_{i+1}^{wb}},\ i = 1, 2, \ldots, M_{wb}, \tag{5}$$

with $A_{M^{wb}}^{wb}+1$ being arbitrarily set to 1, as before. The logarithmic and exponentiation functions may be performed using look-up tables. The LPC coefficients, $\alpha_i^{wb}$, i=1, 2, . . . , $M_{wb}$, are then obtained from the parcors computed in equation (5) by using the Step-Down back-recursion. See, e.g., L. R. Rabiner and R. W. Schafer, Digital Processing of Speech Signals, Prentice Hall, N.J., 1978. These coefficients represent a wideband spectral envelope.

To synthesize the highband signal, the wideband LPC synthesis filter 122, which uses these coefficients, needs to be excited by a signal that has energy in the highband. As seen in the block diagram of FIG. 8, a wideband excitation signal, $r_{wb}$, is generated here from the narrowband residual signal, $\bar{r}_{nb}$, by using fullwave rectification which is equivalent to taking the absolute value of the signal samples. Other nonlinear operators can be used, such as halfwave rectification or infinite clipping of the signal samples. As mentioned earlier, these nonlinear operators and their bandwidth extension characteristics, for example, for flat half-band Gaussian noise input—which models well an LPC residual signal, particularly for an unvoiced input, are discussed below.

Figure 19:
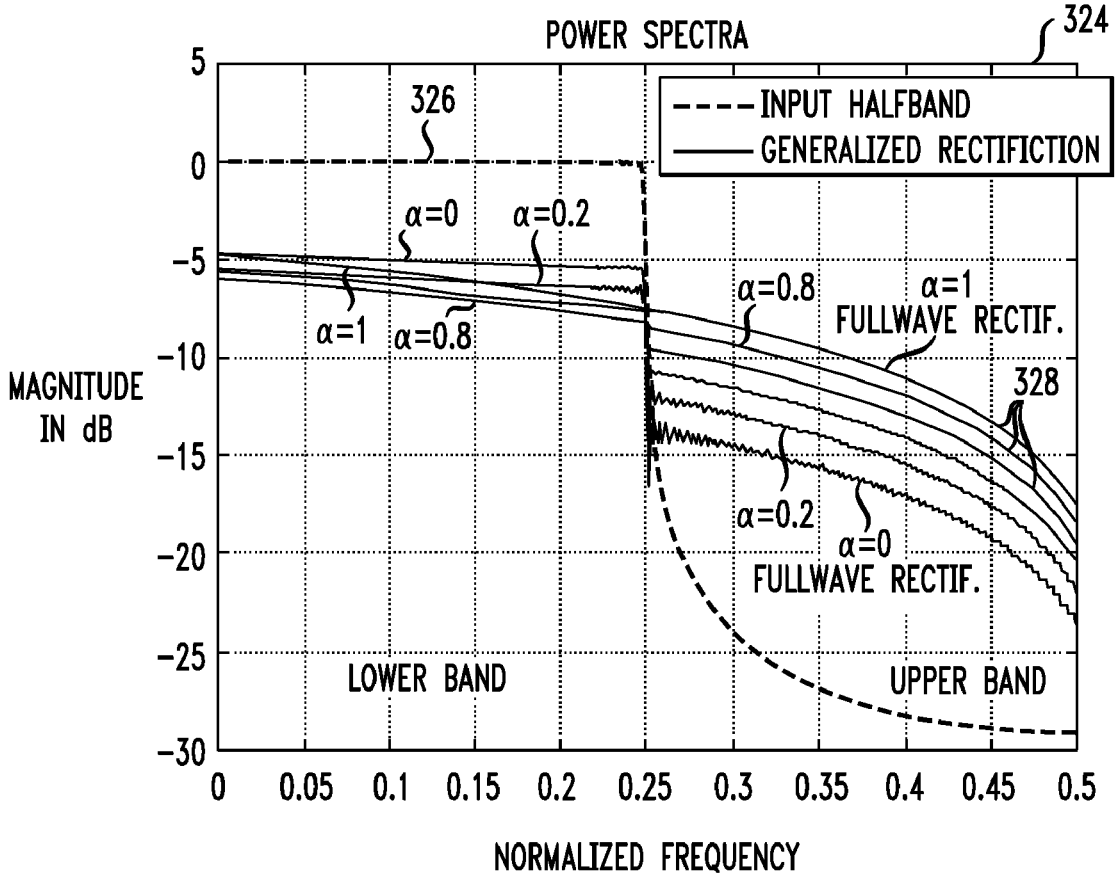
FIG. 19 shows the power spectra of a signal obtained by generalized rectification of the half-band signal generated according to FIG. 18.
Figure 20A:
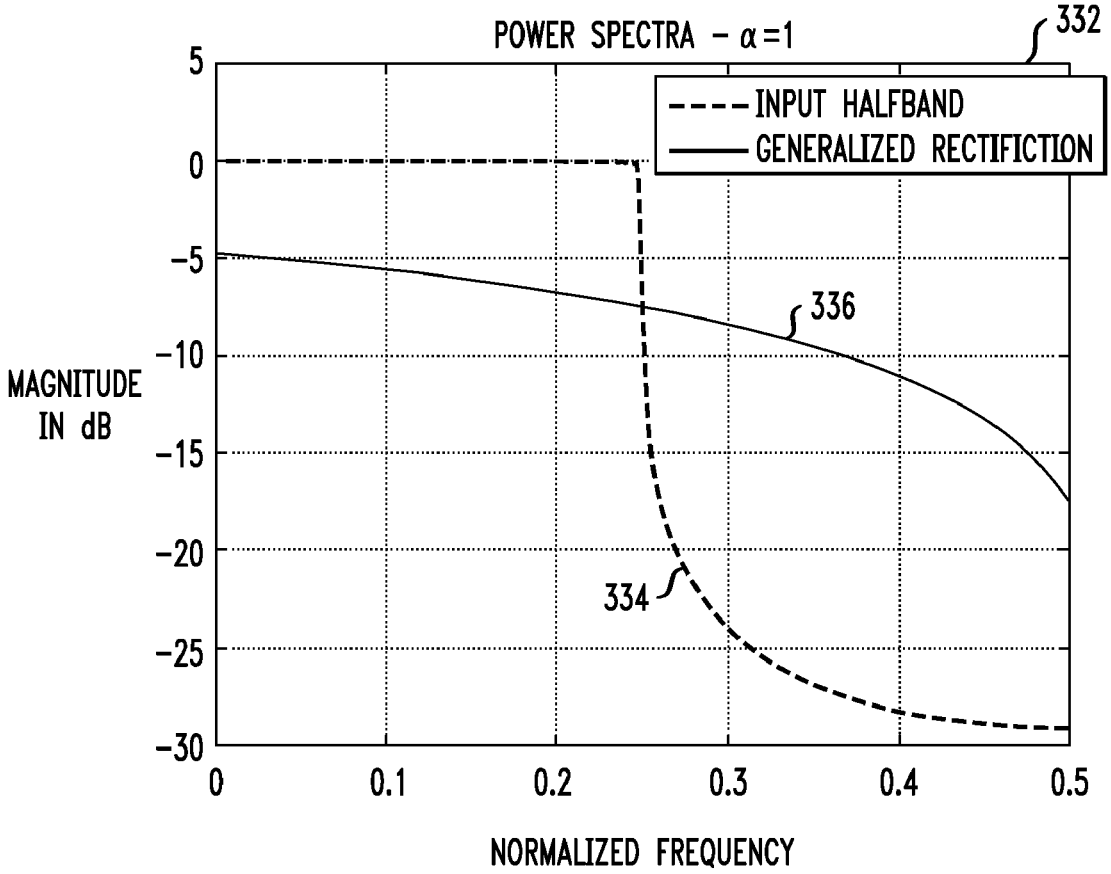
FIG. 20A shows specific power spectra from FIG. 19 for a fullwave rectification.

It is seen from the analysis herein that all the members of a generalized waveform rectification family of nonlinear operators, defined there and includes fullwave and halfwave rectification, have the same spectral tilt in the extended band. Simulations showed that this spectral tilt, of about −10 dB over the whole upper band, is a desired feature and eliminates the need to apply any filtering in addition to highpass filtering 134. Fullwave rectification is preferred. A memoryless nonlinearity maintains signal periodicity, thus avoiding artifacts caused by spectral folding which typically breaks the harmonic structure of voiced speech. The present invention also takes into account that the highband signal of natural wideband speech has pitch dependent time-envelope modulation, which is preserved by the nonlinearity. The inventor's preference of fullwave rectification over the other nonlinear operators considered below is because of its more favorable spectral response. There is no spectral discontinuity and less attenuation—as seen in FIGS. 19 and 20A. If avoidance of spectral tilt is desired, then either the wideband excitation can be flattened via inverse filtering, as discussed above, or infinite clipping can be used having the characteristics shown in FIG. 22.

Another result disclosed herein relates to the gain factor needed following the nonlinear operator to compensate for its signal attenuation. For the selected fullwave rectification followed by subtraction of the mean value of the processed frame, see also equation (6) below, a fixed gain factor of about 2.35 is suitable. For convenience of the implementation, the present disclosure uses a gain value of 2 applied either directly to the wideband residual signal or to the output signal, $y_{wb}$, from the synthesis block 122—as shown in FIG. 8. This scheme works well without an adaptive gain adjustment, which may be applied at the expense of increased complexity.

Since fullwave rectification creates a large DC component, and this component may fluctuate from frame to frame, it is important to subtract it in each frame. I.e., the wideband excitation signal shown in FIG. 8 is given by:

$$r_{wb}(m)=|\bar{r}_{nb}(m)|-\langle\bar{r}_{nb}\rangle \tag{6}$$

where m is the time variable, and $$\langle\tilde{r}_{nb}\rangle=\frac{1}{2N}\sum_{j=1}^{2N}\tilde{r}_{nb}(j) \tag{7}$$

is the mean value computed for each frame of 2N samples where N is the number of samples in the input narrowband signal frame. The mean frame subtraction component is shown as features 130, 132 in FIG. 8.

Since the lower band part of the wideband synthesized signal, $y_{wb}$, is not identical to the original input narrowband signal, the synthesized signal is preferably highpass filtered 134 and the resulting highband signal, $S_{hb}$, is gain adjusted 134 and added 136 to the interpolated narrowband input signal, $\bar{S}_{nb}$, to create the wideband out put signal $\bar{S}_{wb}$. Note that like the gain factor, also the highpass filter can be applied either before or after the wideband LPC synthesis block.

While FIG. 8 shows a preferred implementation, there are other ways for generating the synthesized wideband signal $y_{wb}$. As mentioned earlier, one may use the wideband LPC coefficients $\underline{\alpha}^{wb}$ to generate the signal $\bar{r}_{nb}$ (see also FIG. 5B). If this is the case, and one uses spectral folding to generate $\tilde{r}_{wb}$ (instead of the nonlinear operator used in FIG. 8), then the resulting synthesized signal $y_{wb}$ can serve as the desired output signal and there is no need to highpass it and add the original narrowband interpolated signal as done in FIG. 8 (the HPF needs then to be replaced by a proper shaping filter to attenuate high frequencies, as discussed earlier). The use of spectral folding is, of course, a disadvantage in terms of quality.

Yet another way to generate $y_{wb}$ would be to use the nonlinear operation shown in FIG. 8 on the above residual signal $\tilde{r}_{nb}$ (i.e., obtained by using $\underline{\alpha}^{wb}$), but highpass filter its output, and combine it (after proper gain adjustment) with the interpolated narrowband residual signal $\bar{r}_{nb}$, to produce the wideband excitation signal $r_{wb}$. This signal is fed then into the wideband LPC synthesis filter. Here again the resulting signal, $y_{wb}$, can serve as the desired output signal.

Figure 1A:
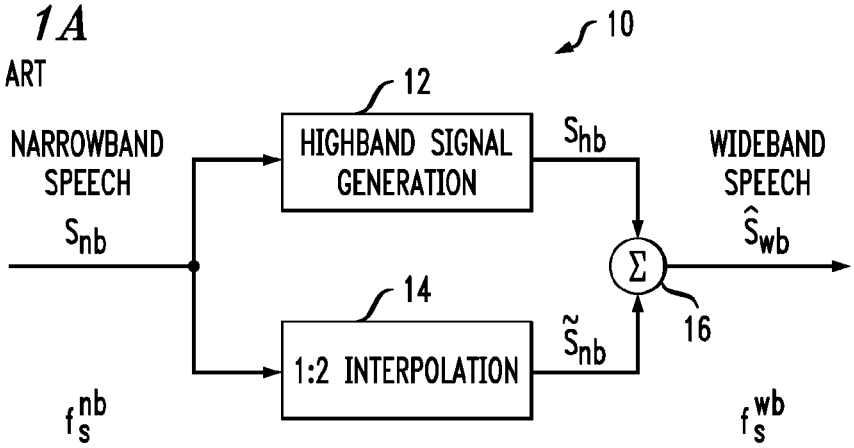
FIG. 1A PRIOR ART
FIGS. 1A and 1B present two general structures for bandwidth extension systems.
Figure 1B:
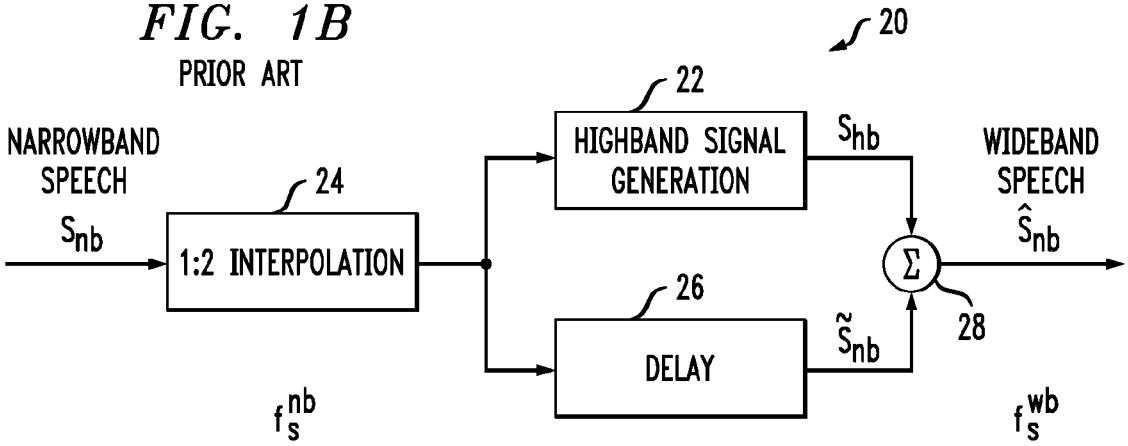
FIG. 1B PRIOR ART
Figure 2A:
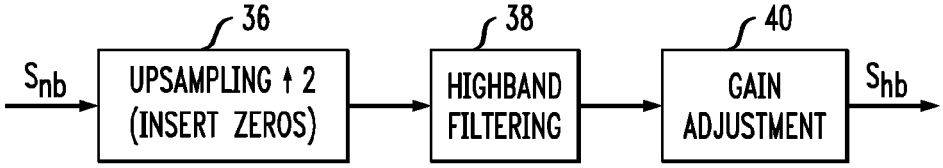
FIGS. 2A and 2B show non-parametric bandwidth extension block diagrams.
Figure 2B:
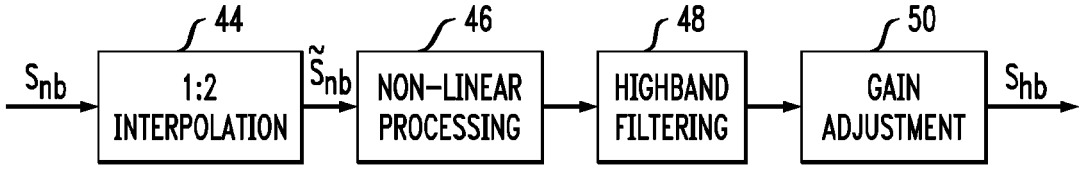
Figure 3:
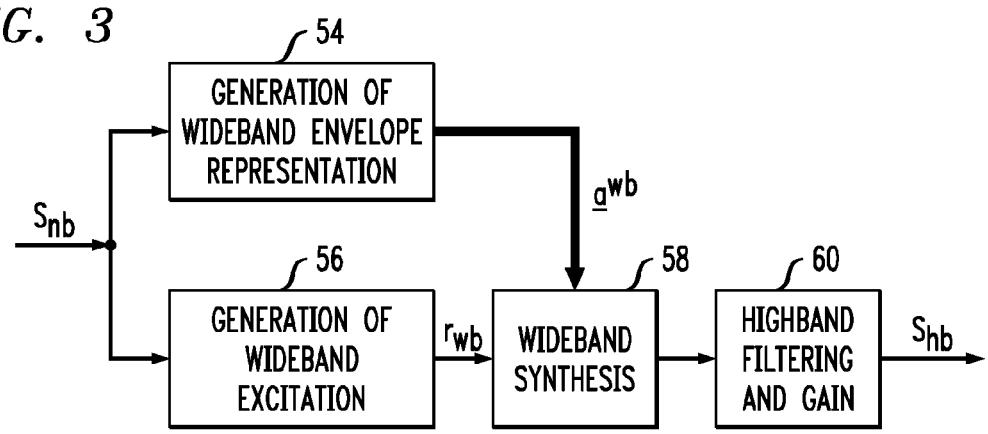
FIG. 3 shows a block diagram of parametric methods for highband signal generation.

Various components shown in FIG. 8 may be combined to form "modules" that perform specific tasks. FIG. 8 provides a more detailed blood diagram of the system shown in FIG. 3. For example, a highband module may comprise the elements in the system from the LPC analysis portion 114 to the highband synthesis portion 122. The highband module receives the narrowband signal and either generates the wideband LPC parameters, or in another aspect of the invention, synthesizes the highband signal using an excitation signal generated from the narrowband signal. An exemplary narrowband module from FIG. 8 may comprise the 1:2 interpolation block 112, the inverse filter 126 and the elements 128, 130 and 132 to generate an excitation signal from the narrowband signal to combine with the synthesis module 122 for generating the highband signal. Thus, as can be appreciated, various elements shown in FIG. 8 may be combined to form modules that perform one or more tasks useful for generating a wideband signal from a narrowband signal.

Another way to generate a highband signal is to excite the wideband LPC synthesis filter (constructed from the wideband LPC coefficients) by white noise and apply highpass filtering to the synthesized signal. While this is a well-known simple technique, it suffers from a high degree of buzziness and requires a careful setting of the gain in each frame.

FIG. 9 illustrates a graph 138 includes the frequency response of a low pass interpolation filter used for 2:1 signal interpolation. Preferably, the filter is a half-band linear-phase FIR filter, designed by the window method using a Blackman window.

Figure 10:
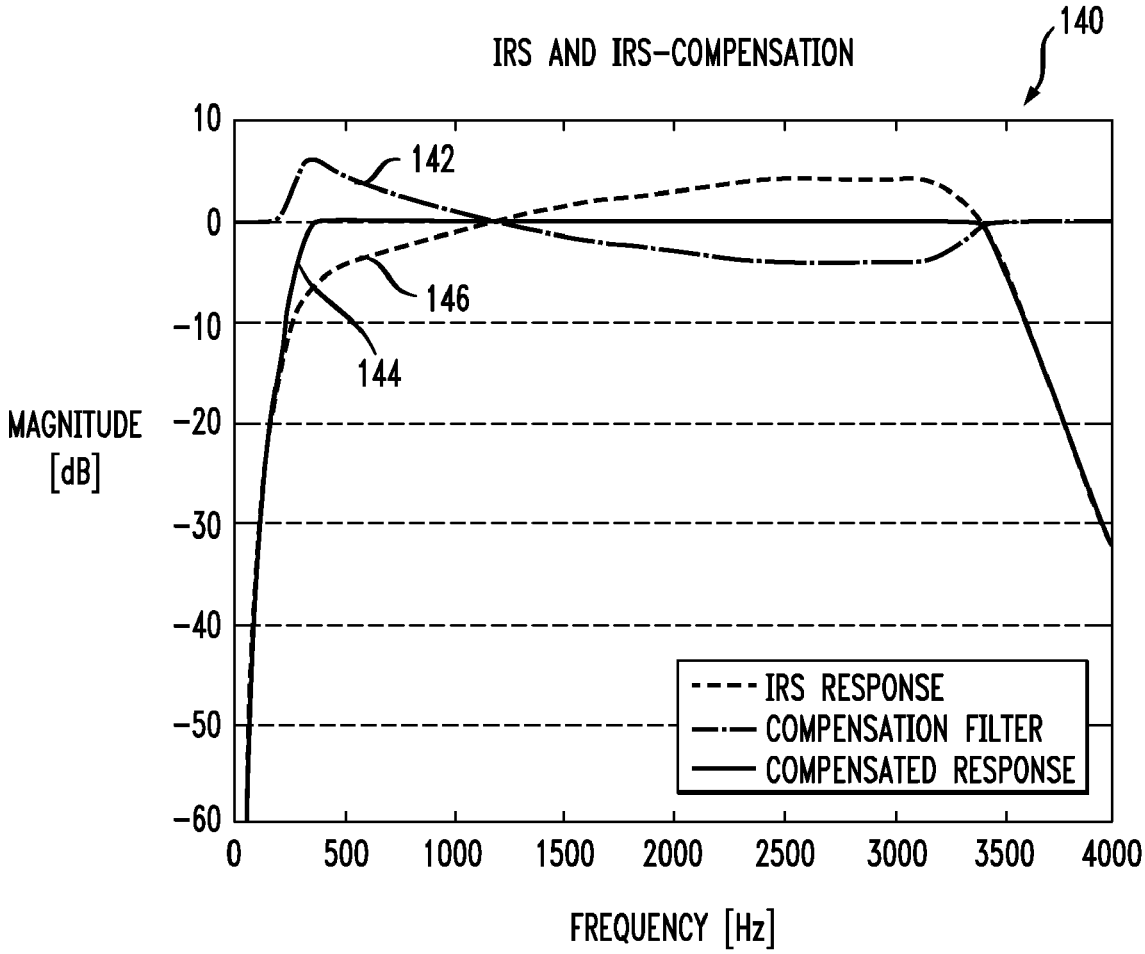
FIG. 10 shows the frequency response of an Intermediate Reference System (IRS), an IRS compensation filter and the cascade of the two.

When the narrowband speech is obtained as an output from a telephone channel, some additional aspects need to be considered. These aspects stem from the special characteristics of telephone channels, relating to the strict band limiting to the nominal range of 300 Hz to 3.4 kHz, and the spectral shaping induced by the telephone channel—emphasizing the high frequencies in the nominal range. These characteristics are quantified by the specification of an Intermediate Reference System (IRS) in Recommendation P.48 of ITU-T (Telecommunication standardization sector of the International Telecommunication Union), for analog telephone channels. The frequency response of a filter that simulates the IRS characteristics is shown in FIG. 10 as a dashed line 146 in a graph 140. For telephone connections that are done over modern digital facilities, a modified IRS (MIRS) specification is discussed herein of Recommendation P.830 of the ITU-T. It has softer frequency response roll-offs at the band edges. We address below the aspects that reflect on the performance of the proposed bandwidth extension system and ways to mitigate them. Also shown in FIG. 10 are the frequency response associated with a compensation filter 142 and the response associated with the cascade of the two (compensated response).

One aspect relates to what is known as the spectral-gap or 'spectral hole', which appears about 4 kHz, in the bandwidth extended telephone signal due to the use of spectral folding of either the input signal directly or of the LP residual signal. This is because of the band limitation to 3.4 kHz. Thus, by spectral folding, the gap from 3.4 to 4 kHz is reflected also to the range of 4 to 4.6 kHz. The use of a nonlinear operator, instead of spectral folding, avoids this problem in parametric bandwidth extension systems that use training. Since, the residual signal is extended without a spectral gap and the envelope extension (via parameter mapping) is based on training, which is done with access the original wideband speech signal.

Since the proposed system 110 according to an embodiment of the present invention does not use training, the narrowband LPC (and hence the area coefficients) are affected by the steep roll-off above 3.4 kHz, and hence affect the interpolated area coefficients as well. This could result in a spectral gap, even when a nonlinear operator is used for the bandwidth extension of the residual signal. Although the auditory effect appears to be very small if any, mitigation of this effect can be achieved either by changing sampling rates. That is, reducing it to 7 kHz at the input (by an 8:7 rate change), extending the signal bandwidth to 7 kHz (at a 14 kHz sampling rate, for example) and increasing it back to 16 kHz, by a 7:8 rate change where the output signal is still extended to 7 kHz only. See, e.g., H. Yasukawa, Enhancement of Telephone Speech Quality by Simple Spectrum Extrapolation Method, in Proc. European Conf. Speech Comm. and Technology, Eurospeech '95, 1995.

This approach is quite effective but computationally expensive. To reduce the computational expense, the following may be implemented: a small amount of white noise may be added at the input to the LPC analysis block 116 in FIG. 8. This effectively raises the floor of the spectral gap in the computed spectral envelope from the resulting LPC coefficients. Alternatively, value of the autocorrelation coefficient R(0) (the power of the input signal), may be modified by a factor $(1+\delta)$, $0<\delta<<1$. Such a modification would result when white noise at a signal-to-noise ratio (SNR) of $1/\delta$ (or $-10\log(\delta)$, in dB) is added to a stationary signal with power R(0). In simulations with telephone bandwidth speech, multiplying R(0) of each frame by a factor of up to approximately 1.1 (i.e., up to $\delta=0.1$) provided satisfactory results.

In addition to the above, and independently of it, it is useful to use an extended highpass filter, having a cutoff frequency $F_c$ matched to the upper edge of the signal band (3.4 kHz in the discussed case), instead at half the input sampling rate (i.e., 4 kHz in this discussion). The extension of the HPF into the lower band results in some added power in the range where the spectral gap may be present due to the wideband excitation at the output of the nonlinear operator. In the implementation described herein, $\delta$ and $F_c$ are parameters that can be matched to speech signal source characteristics.

Another aspect of the present invention relates to the above-mentioned emphasis of high frequencies in the nominal band of 0.3 to 3.4 kHz. To get a bandwidth extended signal that sounds closer to the wideband signal at the source, it is advantageous to compensate this spectral shaping in the nominal band only—so as not to enhance the noise level by increasing the gain in the attenuation bands 0 to 300 Hz and 3.4 to 4 kHz.

In addition to an IRS channel response 146, FIG. 10 shows the response of a compensating filter 142 and the resulting compensated response 144, which is flat in the nominal range. The compensation filter designed here is an FIR filter of length 129. This number could be lowered even to 65, with only little effect. The compensated signal becomes then the input to the bandwidth extension system. This filtering of the output signal from a telephone channel would then be added as a block at the input of the proposed system block-diagram in FIG. 8.

With a band limitation at the low end of 300 Hz, the fundamental frequency and even some of its harmonics may be cut out from the output telephone speech. Thus, generating a subjectively meaningful lowband signal below 300 Hz could be of interest, if one wishes to obtain a complete bandwidth extension system. This problem has been addressed in earlier works. As is known in the art, the lowerband signal may be generated by just applying a narrow (300 Hz) lowpass filter to the synthesized wideband signal in parallel to the highpass filter 134 in FIG. 8. Other known work in the art addresses this issue more carefully by creating a suitable excitation in the lowband, the extended wideband spectral envelope covers this range as well and poses no additional problem.

A nonlinear operator may be used in the present system, according to an aspect of the present invention for extending the bandwidth of the LPC residual signal. Using a nonlinear operator preserves periodicity and generates a signal also in the lowband below 300 Hz. This approach has been used in H. Yasukawa, Restoration of Wide Band Signal from Telephone Speech Using Linear Prediction Error Processing, in Proc. Intl. Conf. Spoken Language Processing, ICSLP '96, pp. 901-904, 1996 and H. Yasukawa, Restoration of Wide Band Signal from Telephone Speech using Linear Prediction Residual Error Filtering, in Proc. IEEE Digital Signal Processing Workshop, pp. 176-178, 1996. This approach includes adding to the proposed system a 300 Hz LPF in parallel to the existing highpass filter. However, because the nonlinear operator injects also undesired components into the lowband (as excitation), audible artifacts appear in the extended lowband. Hence, to improve the lowband extension performance, generation of a suitable excitation signal for voiced speech in the lowband as done in in other references may be needed at the expense of higher complexity See, e.g., G. Mier, A. Gerrits, and J. C. Valiere. Low-Band Extension of Telephone-Band Speech, in Proc. Intl. Conf. Acoust., Speech, Signal Processing ICASSP'00, pp. 1851-1854, 2000. Y. Yoshida and M. Abe, An Algorithm to Construct Wideband Speech from Narrowband Speech Based on Codebook Mapping, in Proc. Intl. Conf. Spoken Language Processing, ICSLP'94,1994; and C. Avendano, H. Hermansky, and E. A. Wan, Beyond Nyquist: Towards the Recovery of Broad-Bandwidth Speech From narrow-Bandwidth Speech, in Proc. European Conf. Speech Comm. and Technology, Eurospeech '95, pp. 165-168, 1995.

The speech bandwidth extension system 110 of the present invention has been implemented in software both in MATLAB® and in "C" programming language, the latter providing a faster implementation. Any high-level programming language may be employed to implement the steps set forth herein. The program follows the block diagram in FIG. 8.

Figure 11:
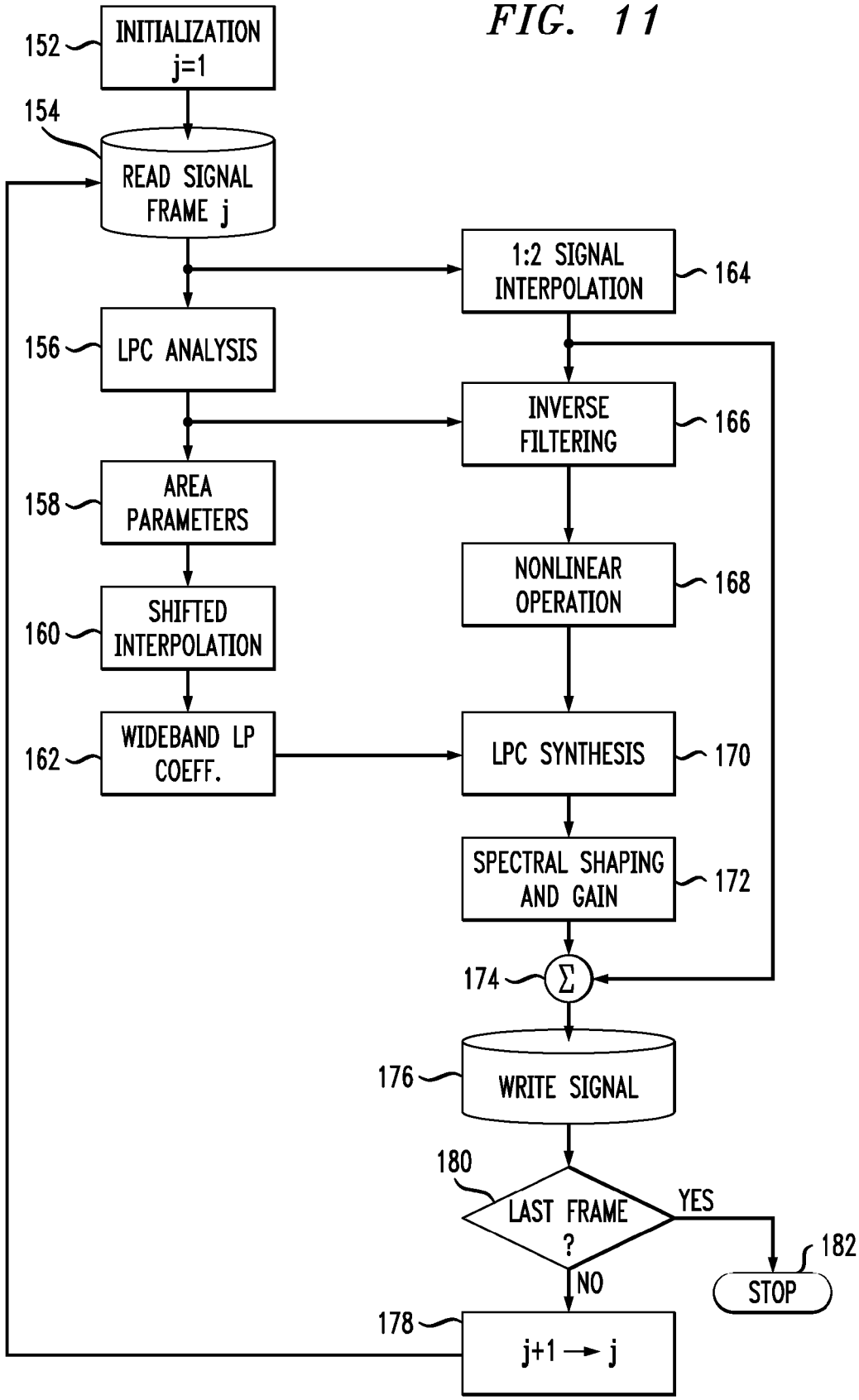
FIG. 11 a flowchart representing an exemplary method of the present invention.

Another aspect of the present invention relates to a method of performing bandwidth extension. Such a method 150 is shown by way of a flowchart in FIG. 11. Some of the parameter values discussed below are merely default values used in simulations. During the Initialization (152), the following parameters are established: Input signal frame length=N (256), Frame update step=N/2, Number of narrowband DATM sections M (8), Sampling Frequency (in Hz)=$f_s^{nb}$ (8000), Input signal upper cutoff frequency in Hz=$F_c$ (3900 for microphone input, 3600 for MIRS input and 3400 for IRS telephone speech), R(0) modification parameter=δ (linearly varying between about 0.01—for Fc=3.9 Khz, to 0.1—for Fc=3.4 kHz, according to input speech bandwidth), and j=1 (initial frame number). The values set forth above are merely examples and each may vary depending on the source characteristics and application. A signal is read from disk for frame j (154). The signal undergoes a LPC analysis (156) that may comprise one or more of the following steps: computing a correlation coefficient $\rho_1$, pre-emphasizing the input signal using $(1-\rho_1 z^{-1})$, windowing of the pre-emphasized signal using, for example, a Hann window of length N, computing M+1 autocorrelation coefficients: R(0), R(1), . . . , R(M), modifying R(0) by a factor (1+δ), and applying the Levinson-Durbin recursion to find LP coefficients $\underline{\alpha}^{nb}$ and parcors $\underline{r}^{nb}$.

Next, the area parameters are computed (158) according to an important aspect of the present invention. Computation of these parameters comprises computing M area coefficients via equation (2) and computing M log-area coefficients. Computing the M log-area coefficients is an optional step but preferably applied by default. The computed area or log-area coefficients are shift-interpolated (160) by a desired factor with a proper sample shift. For example, a shifted-interpolation by factor of 2 will have an associated ¼ sample shift. Another implementation of the factor of 2 interpolation may be interpolating by a factor of 4, shifting one sample, and decimating by a factor of 2. Other shift-interpolation factors may be used as well, which may require an unequal shift per section. The step of shift-interpolation is accomplished preferably using a selected interpolation function such as a linear, cubic spline, or fractal function. The cubic spline is applied by default.

If log-area coefficients are used, exponentiation is applied to obtain the interpolated area coefficients. A look-up table may be used for exponentiation if preferable. As another aspect of the shifted-interpolation step (160), the method may include ensuring that interpolated area coefficients are positive and setting $A_{M+1}^{wb}=1$ The next step relates to calculating wideband LP coefficients (162) and comprises computing wideband parcors from interpolated area coefficients via equation (5) and computing wideband LP coefficients, $\underline{\alpha}^{wb}$, by applying the Step-Down Recursion to the wideband parcors.

Returning now to the branch from the output of step 154, step 164 relates to signal interpolation. Step 164 comprises interpolating the narrowband input signal, $S_{nb}$, by a factor, such as a factor of 2 (upsampling and lowpass filtering). This step results in a narrowband interpolated signal $\tilde{S}_{nb}$. The signal $\tilde{S}_{nb}$ is inverse filtered (166) using, for example, a transfer function of $A_{nb}(z^2)$ having the coefficients shown in equation (4), resulting in a narrow band residual signal $\tilde{r}_{nb}$ sampled at the interpolated-signal rate.

Next, a non-linear operation is applied to the signal output from the inverse filter. The operation comprises fullwave rectification (absolute value) of residual signal $\tilde{r}_{nb}$ (168). Other nonlinear operators discussed below may also optionally be applied. Other potential elements associated with step 168 may comprise computing frame mean and subtracting it from the rectified signal (as shown in FIG. 8), generating a zero-mean wideband excitation signal $r_{wb}$; optional compensation of spectral tilt due to signal rectification (as discussed below) via LPC analysis of the rectified signal and inverse filtering. The preferred setting here is no spectral tilt compensation.

Next, the highband signal must be generated before being added (174) to the original narrowband signal. This step comprises exciting a wideband LPC synthesis filter (170) (with coefficients $\underline{\alpha}^{wb}$) by the generated wideband excitation signal $r_{wb}$, resulting in a wideband signal $y_{wb}$. Fixed or adaptive de-emphasis are optional, but the default and preferred setting is no de-emphasis. The resulting wideband signal $y_{wb}$ may be used as the output signal or may undergo further processing. If further processing is desired, the wideband signal $y_{wb}$ is highpass filtered (172) using a HPF having its cutoff frequency at $F_c$ to generate a highband signal and the gain is adjusted here (172) by applying a fixed gain value. For example, G=2, instead of 2.35, is used when fullwave rectification is applied in step 168. As an optional feature, adaptive gain matching may be applied rather than a fixed gain value. The resulting signal is $S_{hb}$ (as shown in FIG. 8).

Next, the output wideband signal is generated. This step comprises generating the output wideband speech signal by summing (174) the generated highband signal, $S_{hb}$, with the narrowband interpolated input signal, $\tilde{S}_{nb}$. The resulting summed signal is written to disk (176). The output signal frame (of 2N samples) can either be overlap-added (with a half-frame shift of N samples) to a signal buffer (and written to disk), or, because $\tilde{S}_{nb}$ is an interpolated original signal, the center half-frame (N samples out of 2N) is extracted and concatenated with previous output stored in the disk. By default, the latter simpler option is chosen.

The method also determines whether the last input frame has been reached (180). If yes, then the process stops (182). Otherwise, the input frame number is incremented (j+1→j) (178) and processing continues at step 154, where the next input frame is read in while being shifted from the previous input frame by half a frame.

Practicing the method aspect of the invention has produced improvement in bandwidth extension of narrowband speech. FIGS. 12A-12D illustrate the results of testing the present invention. Because the shift-interpolation of the area (or log-area) coefficients is a central point, the first results illustrated are those obtained in a comparison of the interpolation results to true data—available from an original wideband speech signal. For this purpose 16 area coefficients of a given wideband signal were extracted and pairs of area coefficients were averaged to obtain 8 area coefficients corresponding to a narrowband DATM. Shifted-interpolation was then applied to the 8 coefficients and the result was compared with the original 16 coefficients.

Figure 12A:
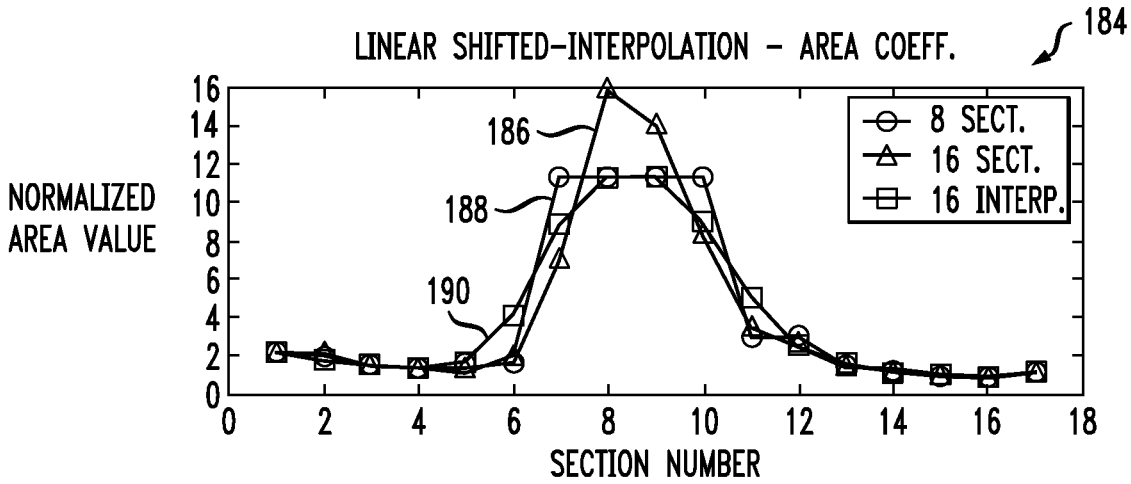
FIGS. 12A-12D illustrate area coefficient and log-area coefficient shifted-interpolation results.

FIG. 12A shows results of linear shifted interpolation of area coefficients 184. Area coefficients of an eight-section tube are shown in plot 188, sixteen area coefficients of a sixteen-section DATM representing the true wideband signal are shown in plot 186 and interpolated sixteen-section DATM coefficients, according to the present invention, are shown in plot 190. Remember, the goal here is to match plot 190 (the interpolated coefficients plot) with the actual wideband speech area coefficients in plot 186.

Figure 12B:
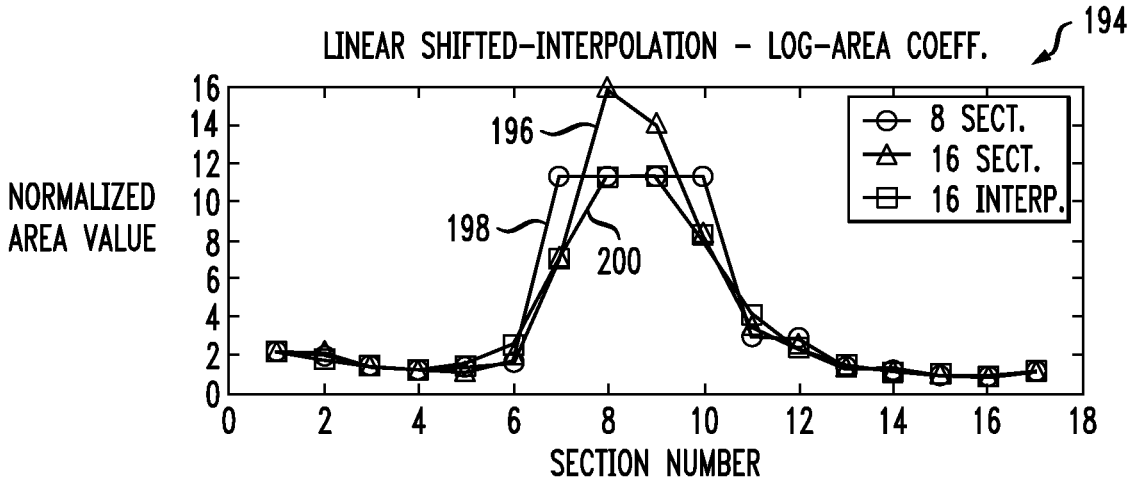

FIG. 12B shows another linear shifted-interpolation plot but of log-area coefficients 194. Area coefficients of an eight-section DATM are shown in plot 198, sixteen area coefficients for the true wideband signal are shown in plot 196 and interpolated sixteen-section DATM coefficients, according to the present invention, are shown as plot 200. The linear interpolated DATM plot 200 of log-area coefficients is only slightly better with respect to the actual wideband DATM plot 196 when compared with the performance shown in FIG. 12A.

Figure 12C:
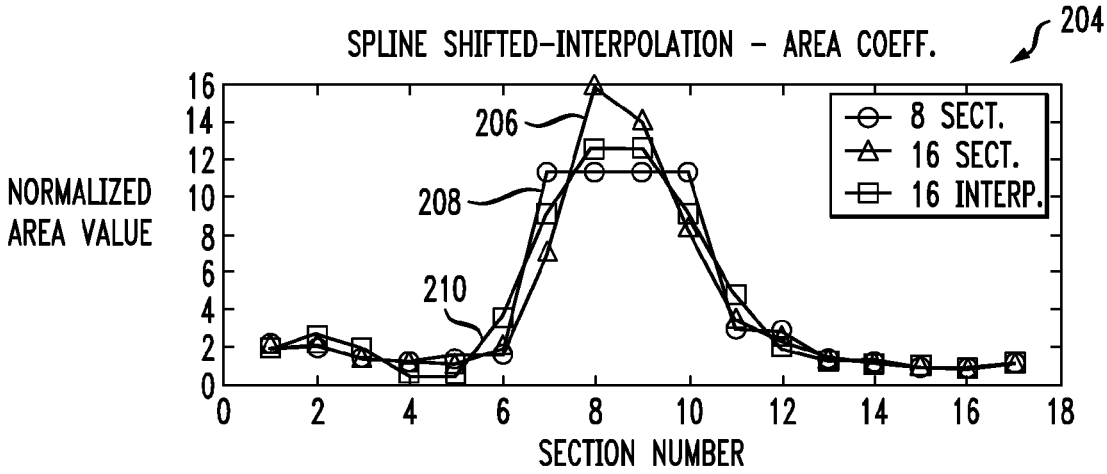

FIG. 12C shows cubic spline shifted-interpolation plot of area coefficients 204. Area coefficients of an eight-section DATM are shown in plot 208, sixteen area coefficients for the true wideband signal are shown in plot 206 and interpolated sixteen-section DATM coefficients, according to the present invention, are shown in plot 210. The cubic-spline interpolated DATM 210 of area coefficients shows an improvement in how close it matches with the actual wideband DATM signal 206 over the linear shifted-interpolation in either FIG. 12A or FIG. 12B.

Figure 12D:
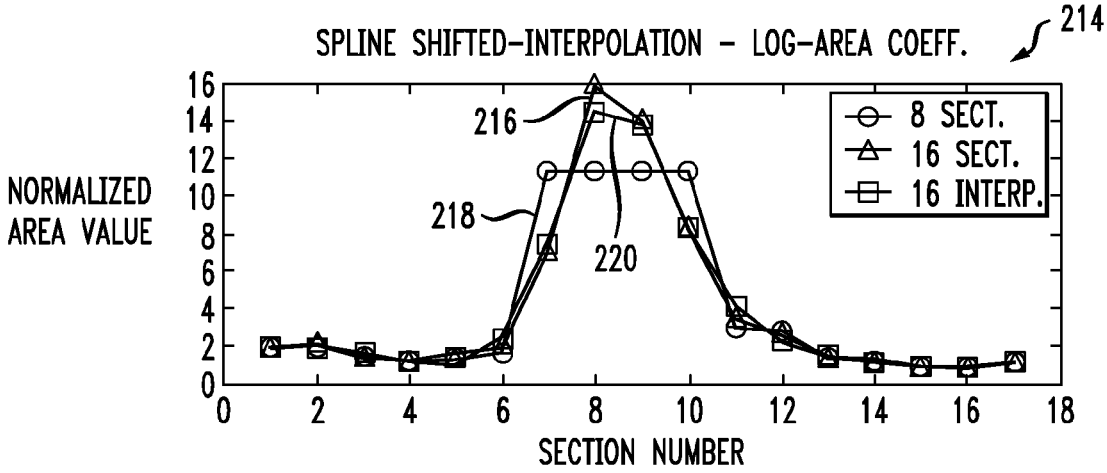

FIG. 12D shows results of spline shifted-interpolation of log-area coefficients 214. Area coefficients of an eight-section DATM are shown in plot 218, sixteen area coefficients for the true wideband signal are shown in plot 216 and interpolated sixteen-section DATM coefficients, obtained according to the present invention by shifted-interpolation of log-area coefficients and conversion to area coefficients, are shown in plot 220. The interpolation plot 220 shows the best performance compared to the other plots of FIGS. 12A-12D, with respect to how closely it matches with the actual wideband signal 216, over the linear shifted-interpolation in either FIGS. 12A, 12B and 12C. The choice of linear over spline shifted-interpolation will depend on the trade-off between complexity and performance. If linear interpolation is selected because of its simplicity, the difference between applying it to the area or log-area coefficients is much smaller, as is illustrated in FIGS. 12A and 12B.

Figure 13A:
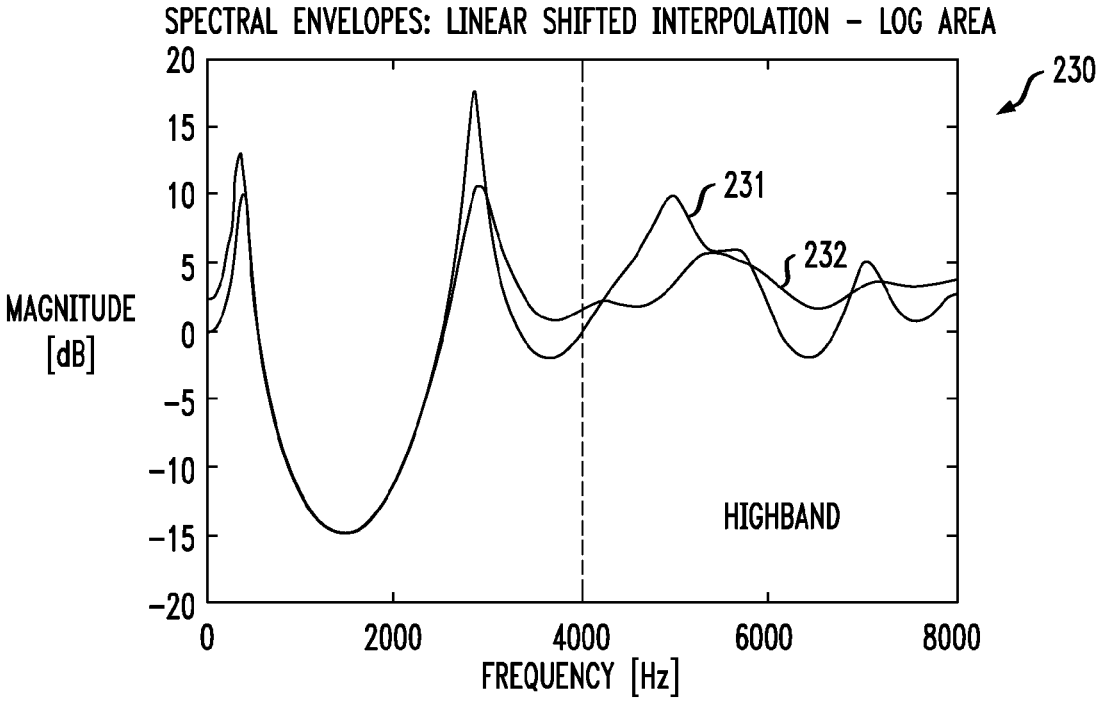
FIGS. 13A and 13B illustrate the spectral envelopes for linear and spline shifted-interpolation, respectively.
Figure 13B:
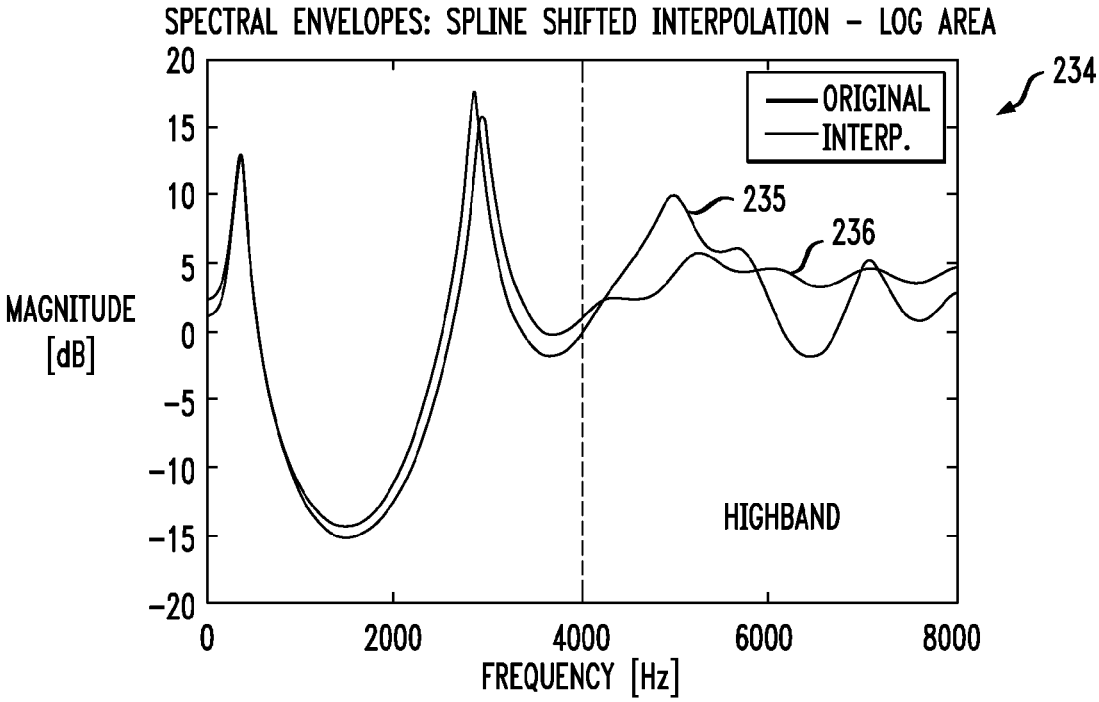

FIGS. 13A and 13B illustrate the spectral envelopes for both linear shifted-interpolation and spline shifted-interpolation of log-area coefficients. FIG. 13A shows a graph 230 of the spectral envelope of the actual wideband signal, plot 231, and the spectral envelope corresponding to the interpolated log-area coefficients 232. The mismatch in the lower band is of no concern since, as discussed above, the actual input narrowband signal is eventually combined with the interpolated highband signal. This mismatch does illustrate, the advantage in using the original narrowband LP coefficients to generate the narrowband residual, as is done in the present invention, instead of using the interpolated wideband coefficients that may not provide effective residual whitening because of this mismatch in the lower band.

FIG. 13B illustrates a graph 234 of the spectral envelope for a spline shifted-interpolation of the log-area coefficients. This figure compares the spectral envelope of an original wideband signal 235 with the envelope that corresponds to the interpolated log-area coefficients 236.

Figure 14A:
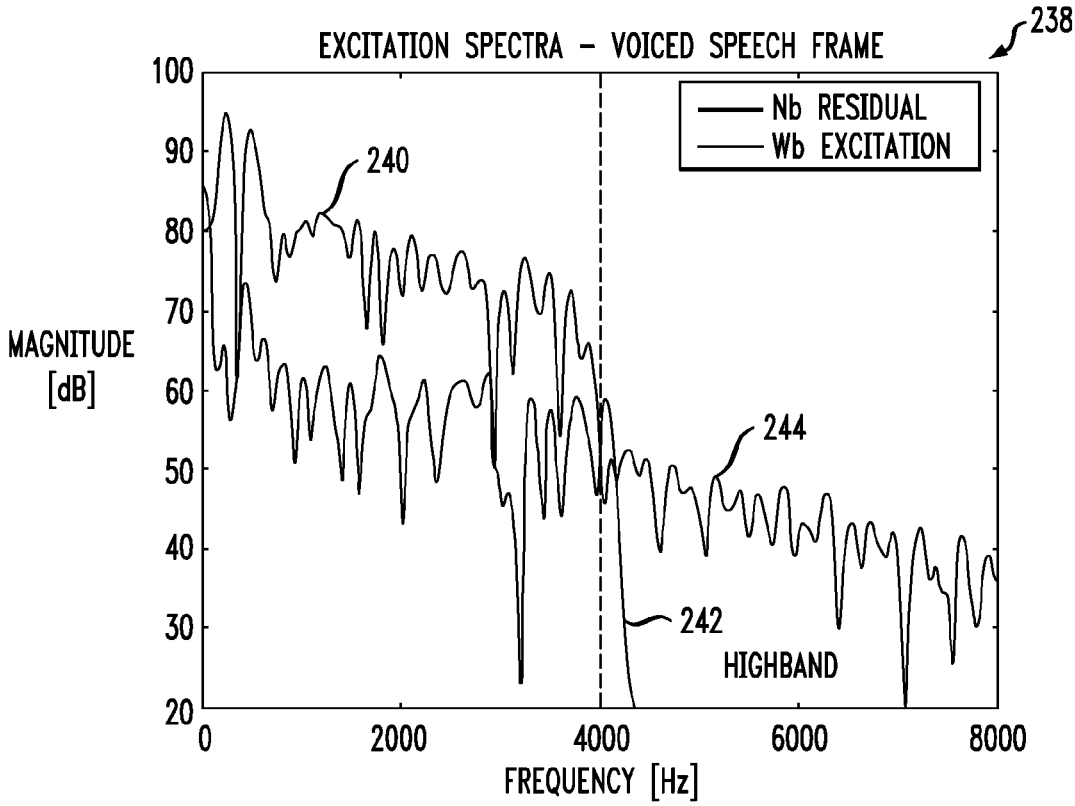
FIGS. 14A and 14B illustrate excitation spectra for a voiced and unvoiced speech frame, respectively.
Figure 14B:
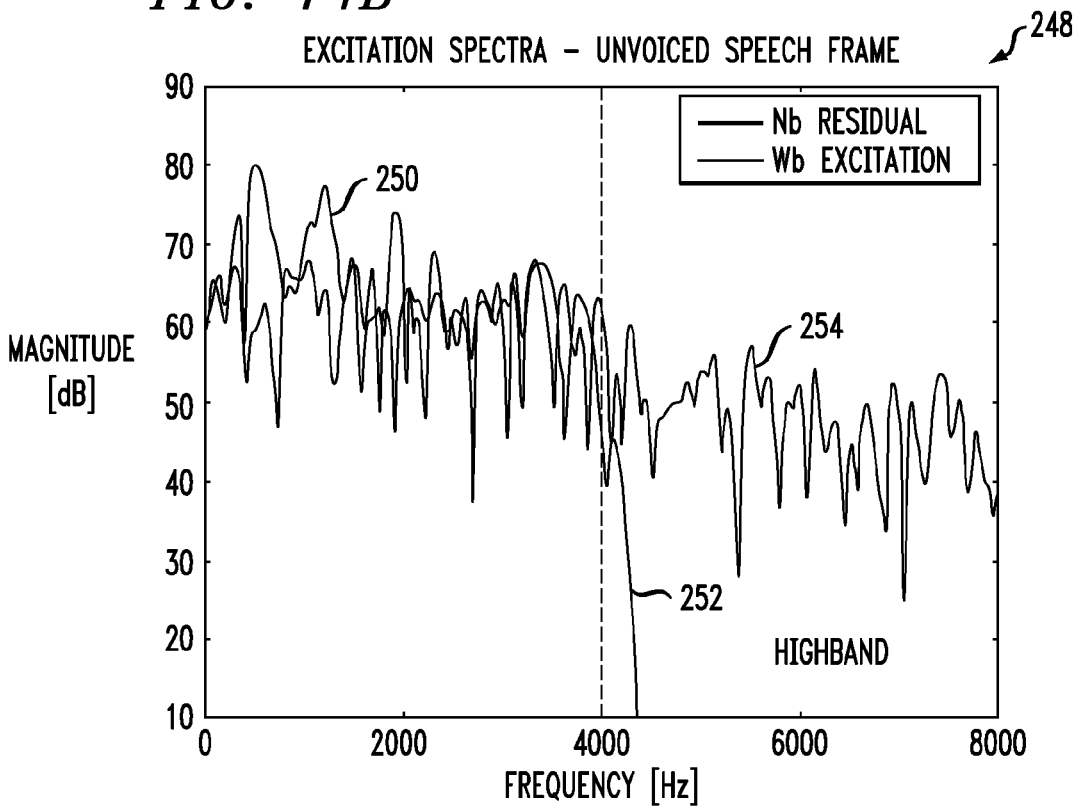

FIGS. 14A and 14B demonstrate processing results by the present invention. FIG. 14A shows the results for a voiced signal frame in a graph 238 of the Fourier transform (magnitude) of the narrowband residual 240 and of the wideband excitation signal 244 that results by passing the narrowband residual signal through a fullwave rectifier. Note how the narrowband residual signal spectrum drops off 242 as the frequency increases into the highband region.

Results for an unvoiced frame are shown in the graph 248 of FIG. 14B. The narrowband residual 250 is shown in the narrowband region, with the dropping off 252 in the highband region. The Fourier transform (magnitude) of the wideband excitation signal 254 is shown as well. Note the spectral tilt of about −10 dB over the whole highband, in both graphs 238 and 248, which fits well the analytic results discussed below.

Figure 15A:
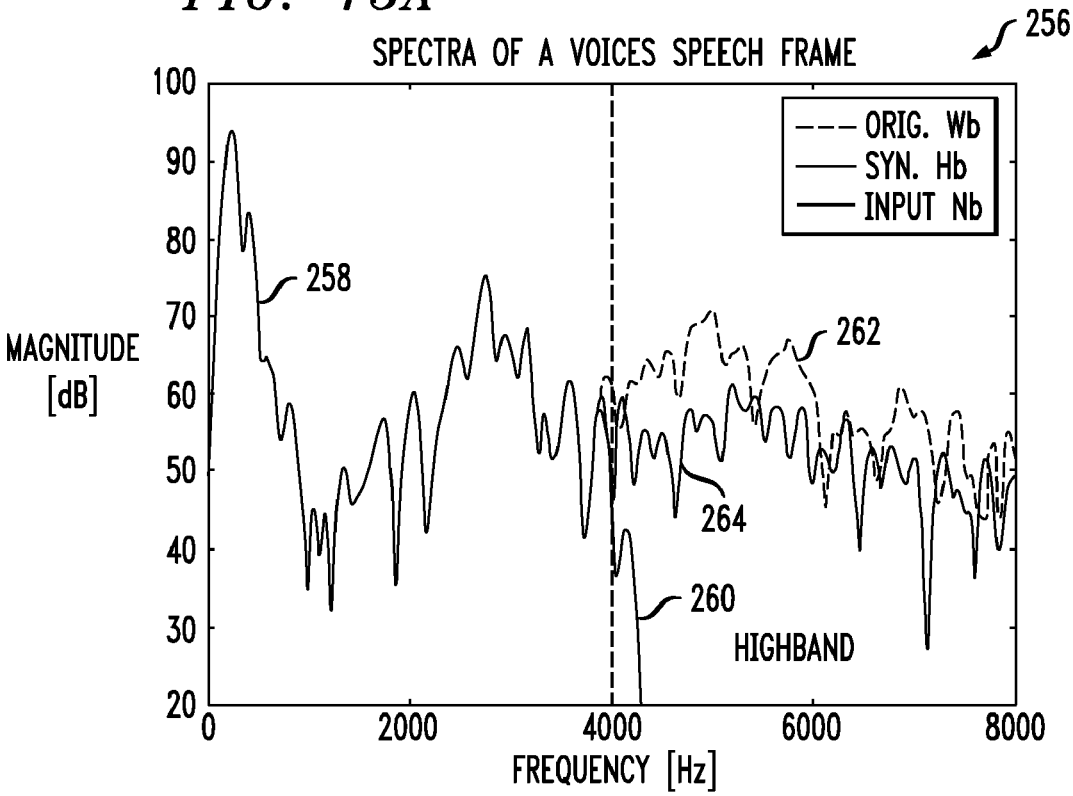
FIGS. 15A and 15B illustrates the spectra of a voiced and unvoiced speech frame, respectively.
Figure 15B:
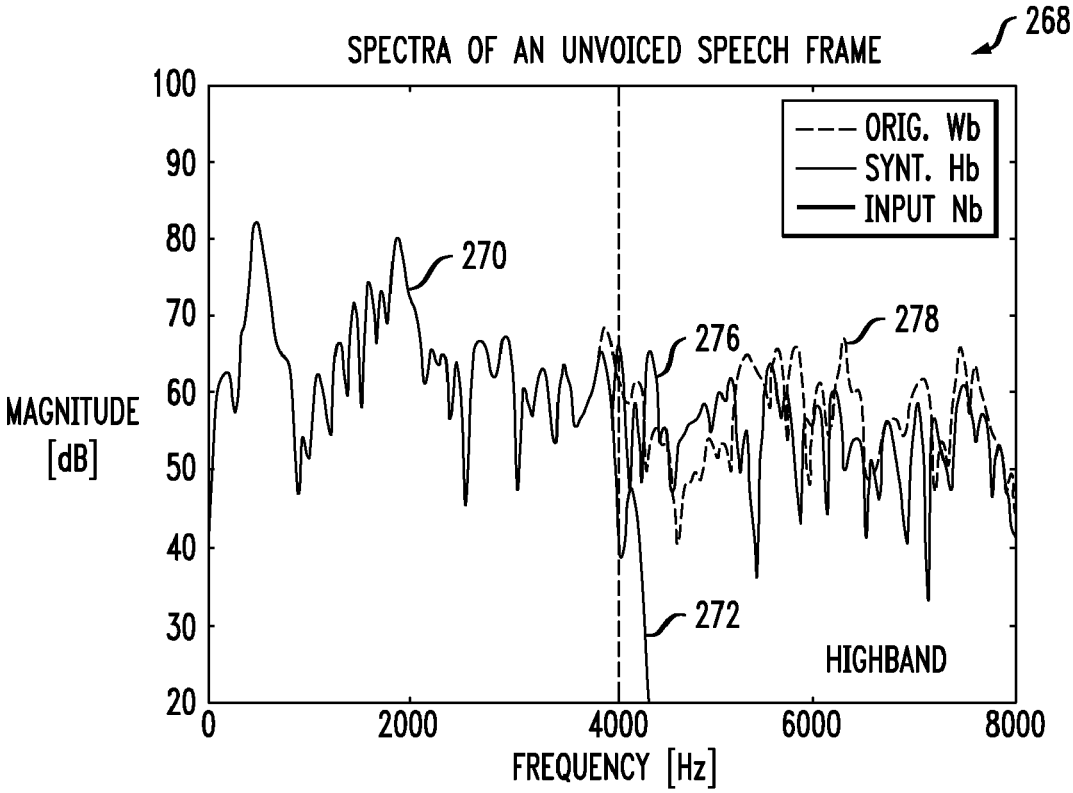
Figure 16A:
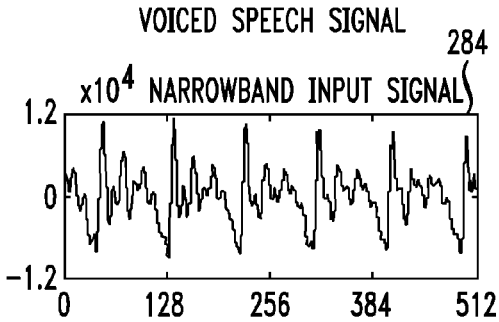
FIGS. 16A through 16E show speech signals at various steps for a voiced speech frame.
Figure 16F:
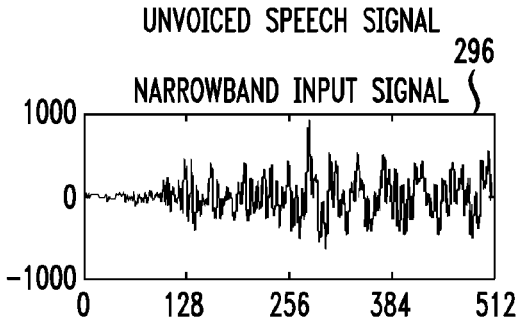
FIGS. 16F through 16J show speech signals at various steps for an unvoiced speech frame.
Figure 16B:
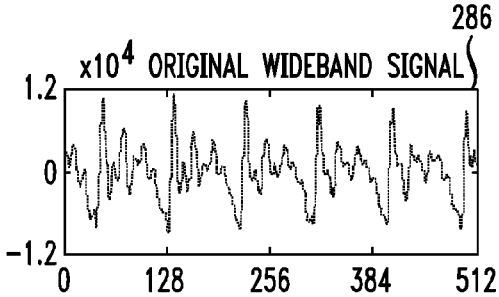
Figure 16G:
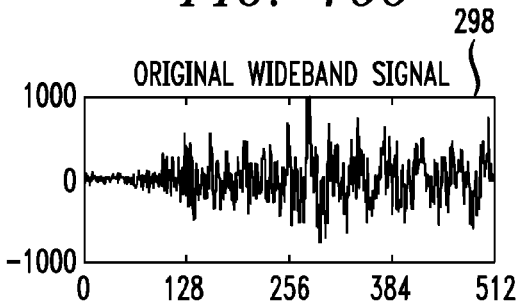
Figure 16C:
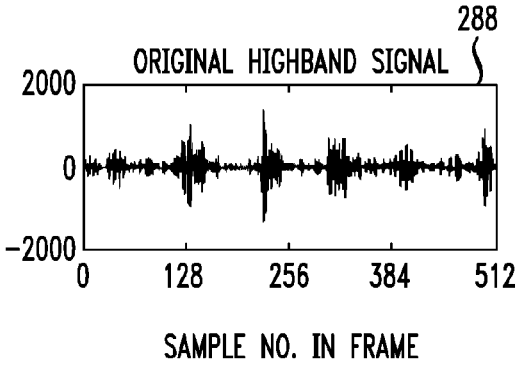
Figure 16H:
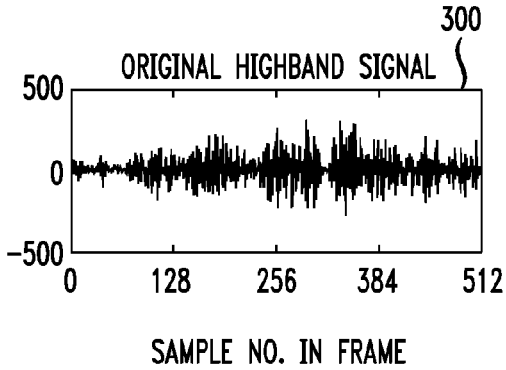
Figure 16D:
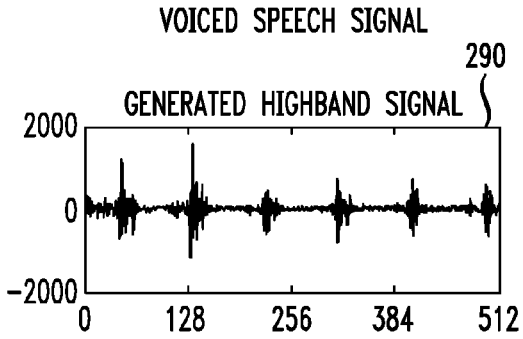
Figure 16I:
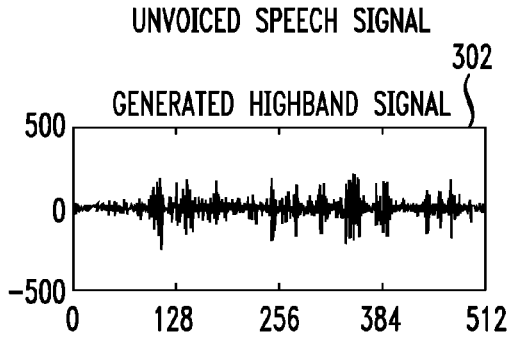
Figure 16E:
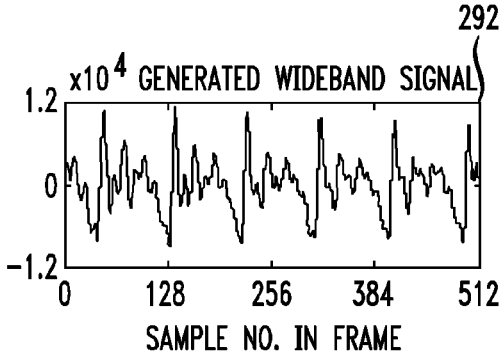
Figure 16J:
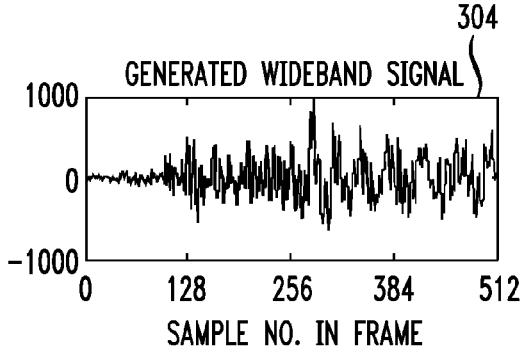

The results obtained by the bandwidth extension system for corresponding frames to those illustrated in FIGS. 14A and 14B are respectively shown in FIGS. 15A and 15B. FIG. 15A shows the spectra for a voiced speech frame in a graph 256 showing the input narrowband signal spectrum 258, the original wideband signal spectrum 262, the synthetic wideband signal spectrum 264 and the drop off 260 of the original narrowband signal in the highband region.

FIG. 15B shows the spectra for an unvoiced speech frame in a graph 268 showing the input narrowband signal spectrum 270, the original wideband signal spectrum 278, the synthetic wideband signal spectrum 276 and the spectral drop off 272 of the original narrowband signal in the highband region.

FIGS. 16A through 16J illustrate input and processed waveforms. FIGS. 16A-16E relate to a voiced speech signal and show graphs of the input narrowband speech signal 284, the original wideband signal 286, the original highband signal 288, the generated highband signal 290 and the generated wideband signal 292. FIGS. 16F through 16J relate to an unvoiced speech signal and shows graphs of the input narrowband speech signal 296, the original wideband signal 298, the original highband signal 300, the generated highband signal 302 and the generated wideband signal 304. Note in particular the time-envelope modulation of the original highband signal, which is maintained also in the generated highband signal.

Applying a dispersion filter such as an allpass nonlinear-phase filter, as in the 2400 bps DoD standard MELP coder, for example, can mitigate the spiky nature of the generated highband excitation.

Figure 17A:
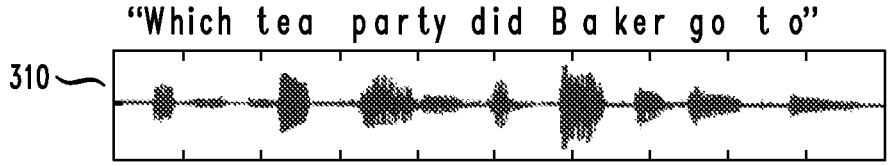
FIG. 17A illustrates a message waveform used for comparative spectograms in FIGS. 17B-17D.
Figure 17B:
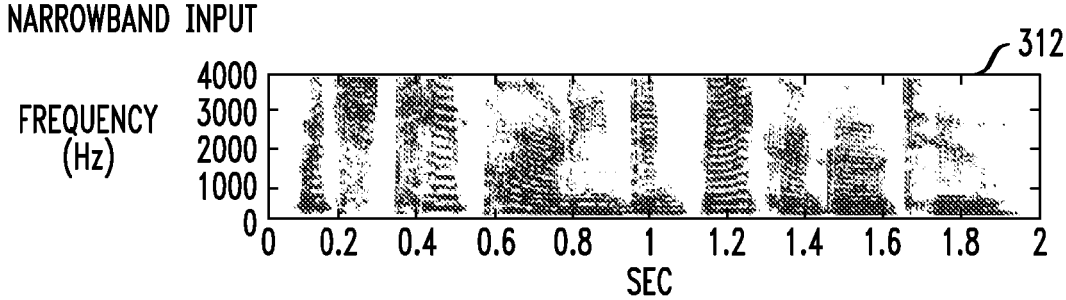
FIGS. 17B-17D illustrate spectrograms for the original speech, narrowband input, bandwidth extension signal and the wideband original signal for the message waveform shown in FIG. 17A.
Figure 17C:
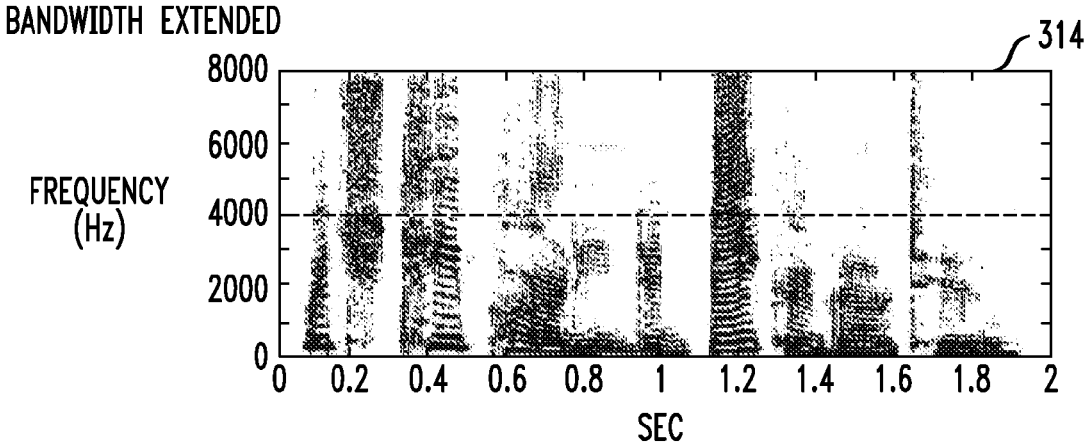
Figure 17D:
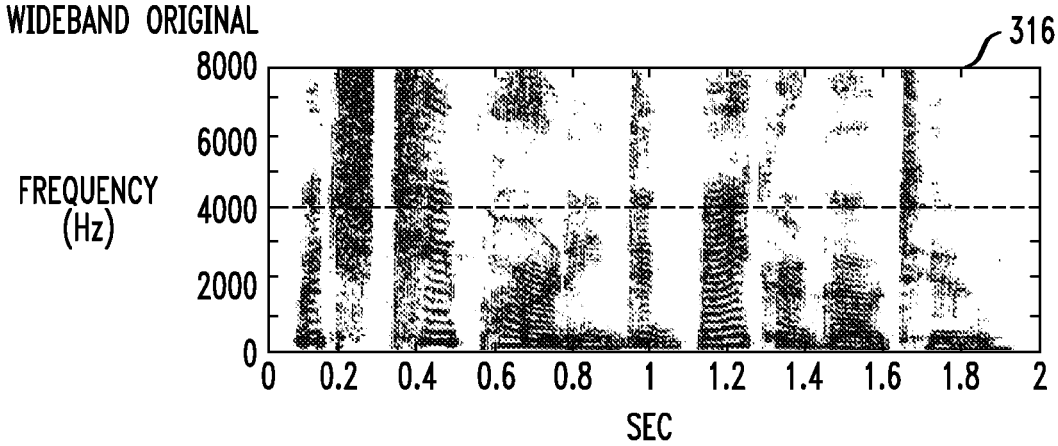

Spectrograms presented in FIGS. 17B-17D show a more global examination of processed results. The signal waveform of the sentence "Which tea party did Baker go to" is shown in graph 310 in FIG. 17A. Graph 312 of FIG. 17B shows the 4 kHz narrowband input spectrogram. Graph 314 of FIG. 17C shows the spectrogram of the bandwidth extended signal to 8 kHz. Finally, graph 316 of FIG. 17D shows the original wideband (8 kHz bandwidth) spectrogram.

An embodiment of the present invention relates to the signal generated according to the method disclosed herein. In this regard, an exemplary signal, whose spectogram is shown in FIG. 17C, is a wideband signal generated according to a method comprising producing a wideband excitation signal from the narrowband signal, computing partial correlation coefficients $r_i$ (parcors) from the narrowband signal, computing $M_{nb}$ area coefficients according to the following equation:

$$A_i = \frac{1+r_i}{1-r_i} A_{i+1};$$

$i=M_{nb}, M_{nb}-1, \ldots, 1$ (where $A_1$ corresponds to the cross-section at lips and $A_{M^{nb}+1}$ corresponds to the cross-section at a glottis opening), computing $M_{nb}$ log-area coefficients by applying a natural-log operator to the $M_{nb}$ area coefficients, extracting $M_{wb}$ log-area coefficients from the $M_{nb}$ log-area coefficients using shifted-interpolation, converting the $M_{wb}$ log-area coefficients into $M_{wb}$ area coefficients, computing wideband parcors $r_i^{wb}$ from the $M_{wb}$ area coefficients according to the following:

$$r_i^{wb} = \frac{A_i^{wb} - A_{i+1}^{wb}}{A_i^{wb} + A_{i+1}^{wb}}, \; i = 1, 2, \ldots, M_{wb},$$

computing wideband linear predictive coefficients LPCs) $a_i^{wb}$ from the wideband parcors $r_i^{wb}$, synthesizing a wideband signal $y_{wb}$ from the wideband LPCs $\alpha_i^{wb}$ and the wideband excitation signal, generating a highband signal $S_{hb}$ by high-pass filtering $y_{wb}$, adjusting the gain and generating the wideband signal by summing the synthesized highband signal $S_{hb}$ and the narrowband signal.

Further, the medium according to this aspect of the invention may include a medium storing instructions for performing any of the various embodiments of the invention defined by the methods disclosed herein.

Having discussed the fundamental principles of the method and system of the present invention, the next portion of the disclosure will discuss nonlinear operations for signal bandwidth extension. The spectral characteristics of a signal obtained by passing a white Gaussian signal, v(n), through a half-band lowpass filter are discussed followed by some specific nonlinear memoryless operators, namely—generalized rectification, defined below, and infinite clipping. The half-band signal models the LP residual signal used to generate the wideband excitation signal. The results discussed herein are generally based on the analysis in chapter 14 of A. Papoulis, Probability, Random Variables and Stochastic Processes, McGraw-Hill, New York, 1965 ("Papoulis").

Figure 18:
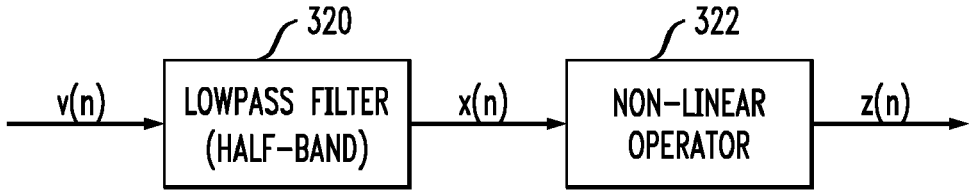
FIG. 18 shows a diagram of a nonlinear operation applied to a bandlimited signal, used to analyze its bandwidth extension characteristics.

Referring to FIG. 18, the signal v(n) is lowpass filtered 320 to produce x(n) and then passed through a nonlinear operator 322 to produce a signal z(n) The lowpass filtered signal x(n) has, ideally, a flat spectral magnitude for $-\pi/2 \leqq 0 \leqq \pi/2$ and zero in the complementing band. The variable θ is the digital radial frequency variable, with $\theta=\pi$ corresponding to half the sampling rate. The signal x(n) is passed through a nonlinear operator resulting in the signal z(n).

Assuming that v(n) has zero mean and variance $\sigma_v^2$, and that the half-band lowpass filter is ideal, the autocorrelation functions of v(n) and x(n) are:

$$R_v(m)=E\{v(n)v(n+m)\}=\sigma_v^2\delta(m), \tag{8}$$

$$R_x(m) = E\{x(n)x(n+m)\} = \frac{1}{2}\frac{\sin(m\pi/2)}{m\pi/2}\sigma_v^2. \tag{9}$$

where $\delta(m)=1$ for $m=0$, and 0 otherwise. Obviously, $\sigma_x^2=\sigma_v^2/2$.

Next addressed is the spectral characteristic of z(n), obtained by applying the Fourier transform to its autocorrelation function, $R_z(m)$, for each of the considered operators.

Generalized rectification is discussed first. A parametric family of nonlinear memoryless operators is suggested for a similar task in J. Makhoul and M. Berouti, High Frequency Regeneration in Speech Coding Systems, in Proc. Intl. Conf. Acoust., Speech, Signal Processing, ICASSP '79, pp. 428-431, 1979 ("Makhoul and Berouti"). The equation for z(n) is given by:

$$z(n) = \frac{1+\alpha}{2}|x(n)| + \frac{1-\alpha}{2}x(n) \tag{10}$$

By selecting different values for α, in the range $0 \leqq \alpha \leqq 1$, a family of operators is obtained. For $\alpha=0$ it is a halfwave rectification operator, whereas for $\alpha=1$ it is a fullwave rectification operator, i.e., $z(n)=|x(n)|$.

Based on the analysis results discussed by Papoulis, the autocorrelation function of z(n) is given here by:

$$R_Z(m) = \left(\frac{1+\alpha}{2}\right)^2 \frac{2}{\pi}\sigma_x^2[\cos(\gamma_m) + \gamma_m\sin(\gamma_m)] + \left(\frac{1-\alpha}{2}\right)^2 R_x(m), \tag{11}$$

where, $$\sin(\gamma_m) = \frac{R_x(m)}{\sigma_x^2}, \; -\pi/2 \le \gamma_m \le \pi/2. \tag{12}$$

Using equation (9), the following is obtained:

$$\sin(\gamma_m) = \frac{\sin(m\pi/2)}{m\pi/2} \tag{13}$$

Since this type of nonlinearity introduces a high DC component, the zero mean variable z'(n), is defined as:

$$z'(n)=z(n)-E\{z\}, \tag{14}$$

From Papoulis and equation (10), using $E\{x\}=0$ the mean value of z(n) is $$E\{z\} = \sqrt{\frac{2}{\pi}}\frac{1+\alpha}{2}\sigma_x, \tag{15}$$

and since $R_z'(m)=R_z(m)-(E\{z\})^2$, equations (11) and (15) give the following:

$$R_{Z'}(m) = \sigma_x^2\left[\left(\frac{1+\alpha}{2}\right)^2\frac{2}{\pi}(\cos(\gamma_m) + \gamma_m\sin(\gamma_m) - 1) + \left(\frac{1-\alpha}{2}\right)^2\sin(\gamma_m)\right], \tag{16}$$

where $\gamma_m$ can be extracted from equation (12).

FIG. 19 shows the power spectra graph 324 obtained by computing the Fourier transform, using a DFT of length 512, of the truncated autocorrelation functions $R_x(m)$ and $R_{z'}(m)$ for different values of the parameter α, and unity variance input—$\sigma_v^2$ $$\left(\text{i.e., } \sigma_x^2 = \tfrac{1}{2}\right).$$

The dashed line illustrates the spectrum of the input half band signal 326 and the solid lines 328 show the generalized rectification spectra for various values of $\alpha$ obtained by applying a 512 point DFT to the autocorrelation functions in equations (9) and (16).

Figure 20B:
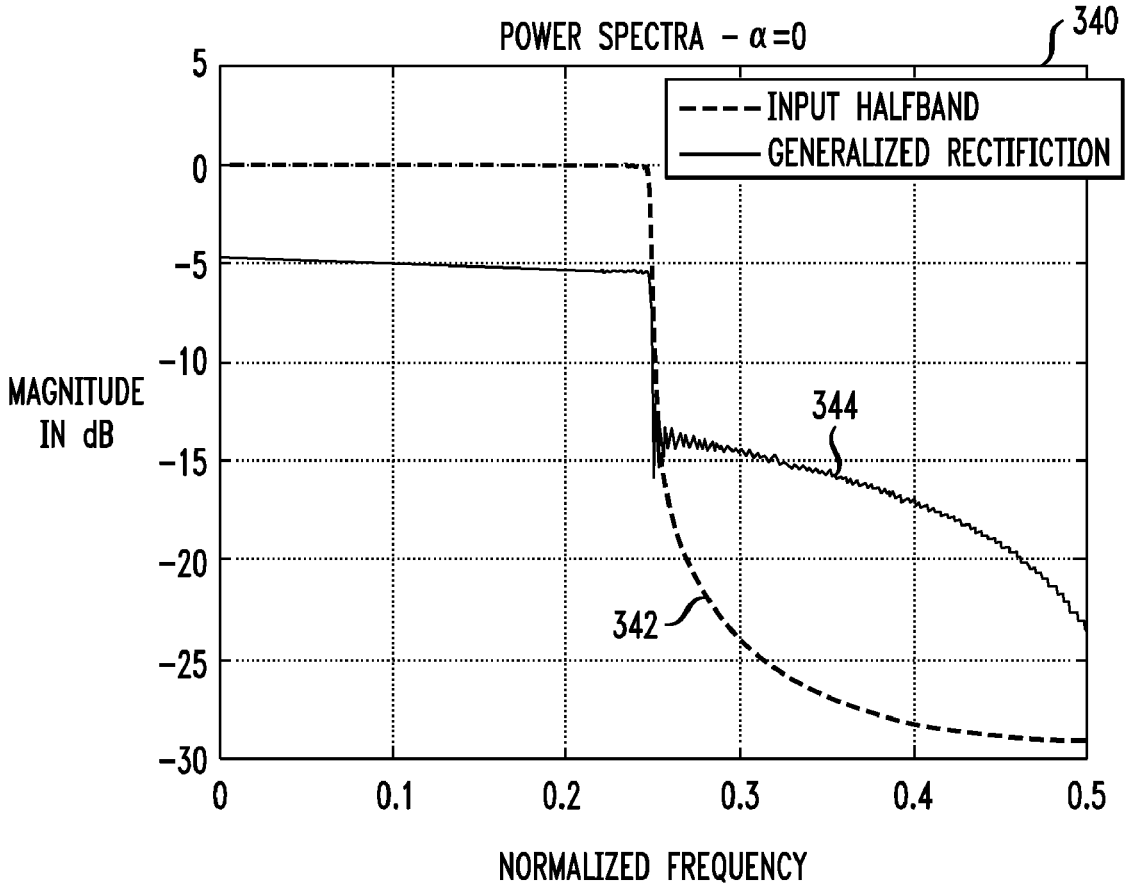
FIG. 20B shows specific power spectra from FIG. 19 for a halfwave rectification.

FIGS. 20A and 20B illustrate the mostly used cases. FIG. 20A shows the results for fullwave rectification 332, i.e., for $\alpha=1$, with the input halfband signal spectrum 334 and the fullwave rectified signal spectrum 336. FIG. 20B shows the results for halfwave rectification 340, i.e., for $\alpha=0$, with the input halfband signal spectrum 342 and the halfwave rectified signal spectrum 344.

A noticeable property of the extended spectrum is the spectral tilt downwards at high frequencies. As noted by Makhoul and Berouti, this tilt is the same for all the values of $\alpha$, in the given range. This is because x(n) has no frequency components in the upper band and thus the spectral properties in the upper band are determined solely by |x(n)| with $\alpha$ affecting only the gain in that band.

To make the power of the output signal z'(n) equal to the power of the original white process v(n), the following gain factor should be applied to z'(n):

$$G_\alpha = \frac{\sigma_v}{\sigma_{z'}} \tag{17}$$

It follows from equations (8) and (17) that:

$$G_\alpha = \frac{1}{\sqrt{\left(\frac{1+\alpha}{2}\right)^2\left(\frac{\pi-2}{2\pi}\right)+\left(\frac{1-\alpha}{2}\right)^2\frac{1}{2}}} \tag{18}$$

Hence, for fullwave rectification ($\alpha=1$), $$G_{fw} = G_{\alpha=1} = \sqrt{\frac{2\pi}{\pi-2}} \cong 2.35, \tag{19}$$

while for halfwave rectification ($\alpha=0$), $$G_{hw} = G_{\alpha=0} = \sqrt{\frac{4\pi}{\pi-1}} \cong 2.42 \tag{20}$$

According to the present invention, the lowband is not synthesized and hence only the highband of z'(n) is used. Assuming that the spectral tilt is desired, a more appropriate gain factor is:

$$G_\alpha^H = \frac{1}{\sqrt{P_\alpha(\theta=\theta_0^+)}}, \tag{21}$$

where $P_\alpha(\theta)$ is the power spectrum of z'(n) and $$\theta_0 = \frac{\pi}{2}$$

corresponds to the lower edge of the highband, i.e., to a normalized frequency value of 0.25 in FIG. 19. The superscript '+' is introduced because of the discontinuity at $\theta_0$ for some values of $\alpha$ (see FIGS. 19 and 20B), meaning that a value to the right of the discontinuity should be taken. In cases of oscillatory behavior near $\theta_0$, a mean value is used.

From the numerical results plotted in FIGS. 20A and 20B, the fullwave and halfwave rectification cases result in:

$$G_{fw}^H = G_{\alpha=1}^H \cong 2.35 \quad G_{hw}^H = G_{\alpha=0}^H \approx 4.58 \tag{22}$$

Figure 21:
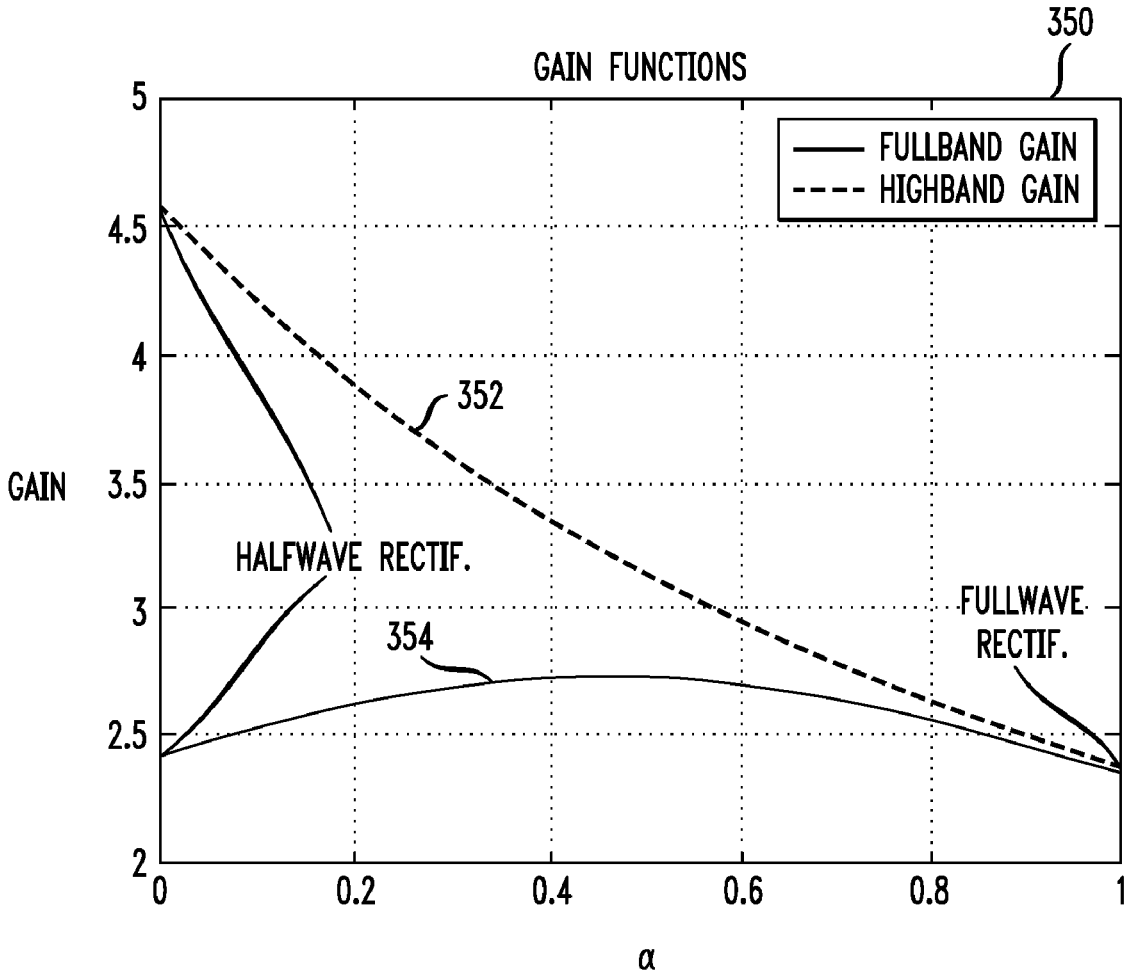
FIG. 21 shows a fullband gain function and a highband gain function.

A graph 350 depicting the values of $G_\alpha$ and $G_\alpha^H$ for $0 \leqq \alpha \leqq 1$ is shown in FIG. 21. This figure shows a fullband gain function $G_\alpha$ 354 and a highband gain function $G_\alpha^H$ 352 as a function of the parameter $\alpha$.

Finally, the present disclosure discusses infinite clippling. Here, z(n) is defined as:

$$z(n) = \begin{cases} 1, & x(n) \geq 0 \\ -1, & x(n) < 0 \end{cases} \tag{23}$$

and from Papoulis:

$$R_Z(m) = \frac{2}{\pi}\gamma_m, \tag{24}$$

where $\gamma_m$ is defined through equation (12) and can be determined from equation (13) for the assumed input signal. Since the mean value of z(n) is zero, z'(n)=z(n).

Figure 22:
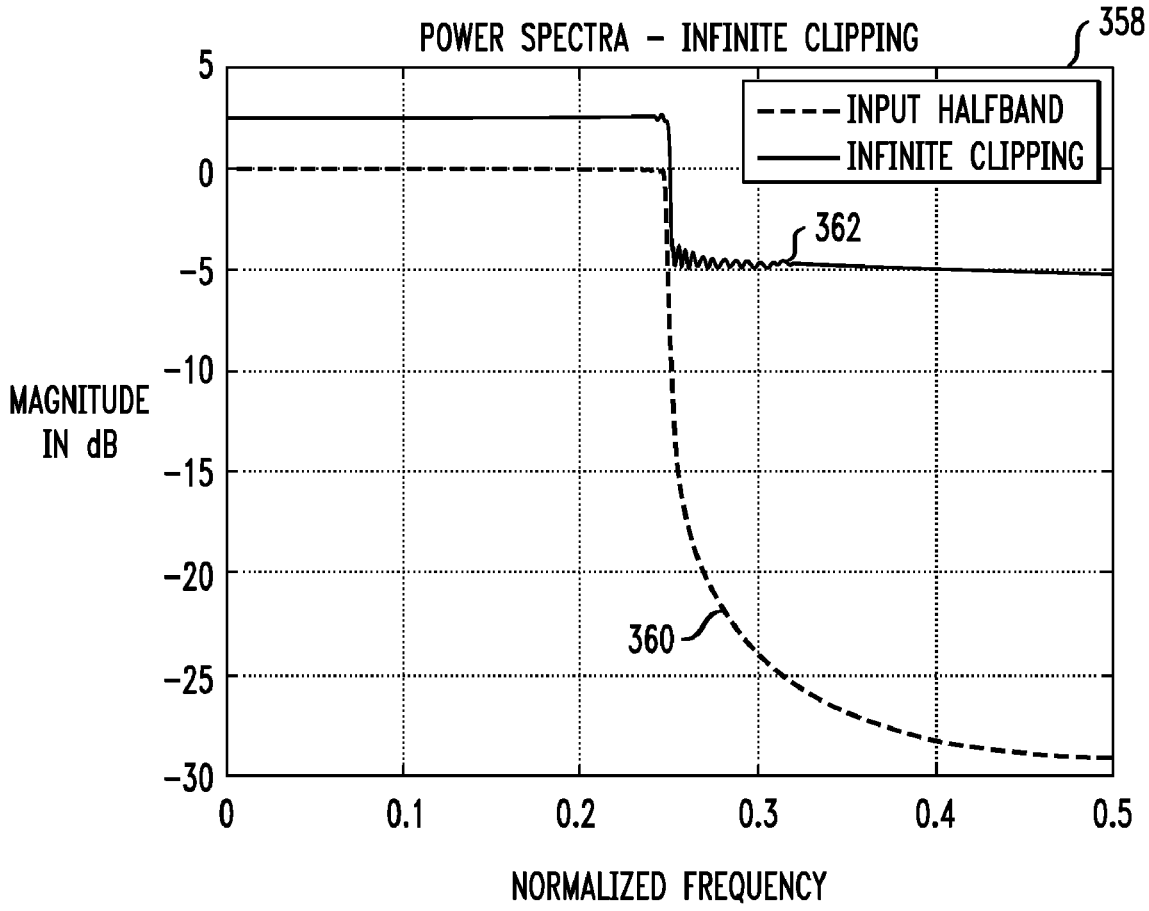
FIG. 22 shows the power spectra of an input half-band excitation signal and the signal obtained by infinite clipping.

The power spectra of x(n) and z(n) obtained by applying a 512 points DFT to the autocorrelation functions in equations (9) and (24) for $\sigma_v^2=1$, are shown in FIG. 22. FIG. 22 is a graph 358 of an input half-band signal spectrum 360 and the spectrum obtained by infinite clipping 362.

The gain factor corresponding to equation (17) is in this case:

$$G_{ic}=\sigma_v=\sqrt{2}\sigma_x \tag{25}$$

Note that unlike the previous case of generalized rectification, the gain factor here depends on the input signal variance power. That is because the variance of the signal after infinite clipping is 1, independently of the input variance. The upper band gain factor, $G_{ic}^H$, corresponding to equation (21), is found to be:

$$G_{ic}^H \approx 1.67\sigma_v \cong 2.36\sigma_x \tag{26}$$

The speech bandwidth extension system disclosed herein offers low complexity, robustness, and good quality. The reasons that a rather simple interpolation method works so well stem apparently from the low sensitivity of the human auditory system to distortions in the highband (4 to 8 kHz), and from the use of a model (DATM) that correspond to the physical mechanism of speech production. The remaining building blocks of the proposed system were selected such as to keep the complexity of the overall system low. In particular, based on the analysis presented herein, the use of fullwave rectification provides not only a simple and effective way for extending the bandwidth of the LP residual signal, computed in a way that saves computations, fullwave rectification also affects a desired built-in spectral shaping and works well with a fixed gain value determined by the analysis.

When the system is used with telephone speech, a simple multiplicative modification of the value of the zeroth autocorrelation term, R(0), is found helpful in mitigating the 'spectral gap' near 4 kHz. It also helps when a narrow lowpass filter is used to extract from the synthesized wideband signal a synthetic lowband (0-300 Hz) signal. Compensation for the high frequency emphasis affected by the telephone channel (in the nominal band of 0.3 to 3.4 kHz) is found to be useful. It can be added to the bandwidth extension system as a preprocessing filter at its input, as demonstrated herein.

It should be noted that when the input signal is the decoded output from a low bit-rate speech coder, it is advantageous to extract the spectral envelope information directly form the decoder. Since low bit-rate coders usually transmit this information in parametric form, it would be both more efficient and more accurate than computing the LPC coefficient from the decoded signal that, of course, contains noise.

Although the above description contains specific details, they should not be construed as limiting the claims in any way. Other configurations of the described embodiments of the invention are part of the scope of this invention. For example, the present invention with its low complexity, robustness, and quality in highband signal generation could be useful in a wide range of applications where wideband sound is desired while the communication link resources are limited in terms of bandwidth/bit-rate. Further, although only the discrete acoustic tube model (DATM) is discussed for explaining the area coefficients and the log-area coefficients, other models may be used that relate to obtaining area coefficients as recited in the claims. Accordingly, the appended claims and their legal equivalents should only define the invention, rather than any specific examples given.

We claim:

1. A method of generating a signal in a communications network, the method comprising:

computing first area coefficients based on narrowband coefficients computed by a linear predictive coefficient module;

generating second area coefficients from the first area coefficients; and generating a wideband signal using the second area coefficients.

2. The method of claim 1, wherein the first area coefficients are further computed based on a narrowband signal.

3. The method of claim 2, wherein first area coefficients are narrowband coefficients and the second area coefficients are wideband area coefficients.

4. The method of claim 2, wherein generating the wideband signal further comprises by combining the wideband signal with the narrowband signal interpolated to a narrowband signal sampling rate.

5. The method of claim 1, wherein generating second area coefficients from the first area coefficients further comprises generating the second area coefficients using interpolation.

6. The method of claim 1, wherein computing first area coefficients from the narrowband coefficients further comprises computing the first area coefficients using partial correlation coefficients (parcors) from a signal associated with the narrowband coefficients.

7. A system for generating a signal and a communication network comes out of a system comprising:

a processor;

a module configured to control the processor to compute first area coefficient based on narrowband coefficient computed by a linear predictive coefficient module;

a module configured to control the processor to generate second area coefficients from the first area coefficients; and a module configured to control the processor to generate a wideband signal using the second area coefficients.

8. The system of claim 7, wherein the first area coefficients are further computed based on a narrowband signal.

9. The system of claim 8, wherein the first area coefficients are narrowband coefficients and second coefficients are wideband area coefficients.

10. The system of claim 8, wherein the module configured to control the processor to generate the wideband signal further controls the processor to combine the wideband signal with the narrowband signal interpolated to a narrowband signal sampling rate.

11. The system of claim 7, wherein the module that is configured to control the processor to generate second coefficients from the first area coefficients further controls the processor to generate the second area coefficients using interpolation.

12. The system of claim 7, wherein the module configured to control the processor to compute the first area coefficients from the narrowband coefficients further controls the processor to compute the first area coefficients using partial correlation coefficients (parcors) from a signal associated with the narrowband coefficients.

13. A tangible computer-readable medium storing a computer program having instructions for controlling a computer device to generate a signal in a communication network according to the following method:

computing first area coefficients based on narrowband coefficients computed by a linear predictive coefficient module;

generating second area coefficients from the first area coefficients; and generating a wideband signal using the second area coefficients.

14. The computer-readable medium of claim 13, wherein the first coefficients are further computed based on narrowband signal.

15. The computer-readable medium of claim 14, wherein the first coefficients are narrowband coefficients and the second area coefficients are wideband coefficients.

16. The computer-readable medium of claim 14, wherein generating the wideband signal further comprises combining the wideband signal with the narrowband signal interpolate to a narrowband signal sampling rate.

17. The computer-readable medium of claim 13, wherein generating second area coefficients from the first area coefficients further comprises generating the second area coefficients using interpolation.

18. The computer-readable medium of claim 13, wherein computing first area coefficients from the narrowband coefficients further comprises computing the first area coefficients using partial correlation coefficients (parcors) from a signal associated with a narrowband coefficients.

* * * * *